US012788099B2

(12) United States Patent
Schindler et al.

(10) Patent No.: US 12,788,099 B2
(45) Date of Patent: Nov. 10, 2026

(54) FACE SHIELD WITH DEBRIS/DUST CONTROL

(71) Applicant: Milwaukee Electric Tool Corporation, Brookfield, WI (US)

(72) Inventors: Brady James Schindler, Oconomowoc, WI (US); Michael J. Brock, Sussex, WI (US); Dennis A Yakes, Elkhorn, WI (US); Trent T. Bauters, West Allis, WI (US); Shahrukh Khan Patan, Milwaukee, WI (US); Parker E. Tibbs, Milwaukee, WI (US); Craig A. Fluegge, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/544,011

(22) Filed: Dec. 18, 2023

(65) Prior Publication Data

US 2024/0268503 A1 Aug. 15, 2024

Related U.S. Application Data

(60) Provisional application No. 63/593,763, filed on Oct. 27, 2023, provisional application No. 63/497,519, (Continued)

(51) Int. Cl.
*A42B 3/22* (2006.01)

(52) U.S. Cl.
CPC ..... *A42B 3/225* (2013.01); *A42B 3/223* (2013.01)

(58) Field of Classification Search
CPC ..... A42B 3/225; A42B 3/223; A42B 3/22; A42B 3/18; A42B 3/04; A42B 3/20; A42B 3/221; A42B 3/227; A42B 3/226; A42B 3/228; A42B 3/222; A42B 3/26; A42B 1/018; A42B 1/0181; A42B 1/0182; A42B 1/0184; A42B 1/0185; A41D 13/1184
See application file for complete search history.

(56) References Cited

U.S. PATENT DOCUMENTS 3,668,705 A 6/1972 Garbisch
4,315,335 A 2/1982 Kennedy et al.
(Continued)

FOREIGN PATENT DOCUMENTS

CN 101980752 7/2012
CN 101983020 11/2012
(Continued)

OTHER PUBLICATIONS

Photographic Image 1 of MSA Hard Hat Face Shield Frame.
(Continued)

*Primary Examiner* — Uyen T Nguyen
(74) *Attorney, Agent, or Firm* — Reinhart Boerner Van Deuren s.c.

(57) ABSTRACT

Various embodiments of face shield assemblies for hard hats are provided. The face shield assemblies include structures that block, control, or capture dust and debris to reduce the amount of dust or debris that falls onto the wearer's face during use. Some embodiments of the face shield assemblies include a hinge that includes a pivot projection having pivot wings that are inserted into a slot of a pivot receiver.

17 Claims, 42 Drawing Sheets

Related U.S. Application Data filed on Apr. 21, 2023, provisional application No. 63/484,872, filed on Feb. 14, 2023.

(56) References Cited

U.S. PATENT DOCUMENTS

| | | | | |
|---|---|---|---|---|
| 4,536,892 | A | 8/1985 | Brinkhoff et al. | |
| 4,928,324 | A * | 5/1990 | Evans | A42B 3/225 2/10 |
| 5,970,514 | A * | 10/1999 | Wang-Lee | A42B 3/225 2/9 |
| 6,035,451 | A | 3/2000 | Burns et al. | |
| 6,298,498 | B1 | 10/2001 | Burns et al. | |
| 8,534,279 | B2 | 9/2013 | Davies et al. | |
| 8,677,517 | B1 | 3/2014 | Croteau et al. | |
| 9,848,667 | B2 | 12/2017 | Kilmer et al. | |
| 10,709,194 | B2 | 7/2020 | Johnstone et al. | |
| 11,219,265 | B2 | 1/2022 | Pfanner | |
| 11,583,023 | B2 | 2/2023 | Jones et al. | |
| 2004/0244098 | A1* | 12/2004 | Sumitomo | A42B 3/281 2/410 |
| 2011/0016595 | A1* | 1/2011 | Brace | A42B 3/225 29/527.1 |
| 2012/0222199 | A1* | 9/2012 | Tatomir | A42B 3/20 2/422 |
| 2015/0201696 | A1 | 7/2015 | Pfanner | |
| 2018/0103710 | A1* | 4/2018 | Kim | A42B 3/326 |
| 2022/0030977 | A1 | 2/2022 | Huh et al. | |
| 2022/0047030 | A1 | 2/2022 | Summersett et al. | |
| 2022/0095736 | A1 | 3/2022 | Henshaw | |
| 2023/0148698 | A1 | 5/2023 | Jones et al. | |
| 2023/0157398 | A1 | 5/2023 | Lombardi et al. | |

FOREIGN PATENT DOCUMENTS

| | | | | |
|---|---|---|---|---|
| CN | 107920616 | | 7/2020 | |
| CN | 114053613 | | 2/2022 | |
| DE | 3511508 | | 10/1985 | |
| DE | 9107264 | | 1/1992 | |
| DE | 102012015023 | | 1/2014 | |
| EP | 1061824 | | 10/2003 | |
| EP | 2877050 | | 10/2016 | |
| EP | 2768333 | | 3/2017 | |
| EP | 2271229 | | 6/2018 | |
| EP | 2271407 | | 4/2019 | |
| EP | 3302118 | | 8/2019 | |
| EP | 3340826 | | 3/2020 | |
| EP | 3944781 | | 2/2022 | |
| WO | WO1999045810 | | 9/1999 | |
| WO | WO2009123809 | | 10/2009 | |
| WO | WO2009123947 | | 10/2009 | |
| WO | WO2013057745 | | 4/2013 | |
| WO | WO2014016264 | | 1/2014 | |
| WO | WO2016189265 | | 12/2016 | |
| WO | WO-2016189265 | A1 * | 12/2016 | A42B 3/222 |
| WO | WO2017032981 | | 3/2017 | |
| WO | WO2022072556 | | 4/2022 | |

OTHER PUBLICATIONS

Photographic Image 2 of MSA Hard Hat Face Shield Frame.
Photographic Image 3 of MSA Hard Hat Face Shield Frame.
Photographic Image 4 of MSA Hard Hat Face Shield Frame.
Photographic Image 5 of MSA Hard Hat Face Shield Frame.

* cited by examiner

FACE SHIELD WITH DEBRIS/DUST CONTROL

CROSS REFERENCE TO RELATED PATENT APPLICATIONS

The present application claims the benefit of and priority to U.S. Provisional Application No. 63/593,763 filed Oct. 27, 2023, and U.S. Provisional Application No. 63/497,519 filed Apr. 21, 2023, and U.S. Provisional Application No. 63/484,872 filed Feb. 14, 2023, each of which are incorporated herein by reference in their entireties.

BACKGROUND OF THE INVENTION

The present invention relates generally to the field of safety equipment. The present invention relates specifically to a face shield system attachable to a hard hat or protective helmet.

SUMMARY OF THE INVENTION

One embodiment of the invention relates to a hard hat system including a hard hat having a brim and a shell formed from a rigid material. The hard hat is configured to receive a head of a wearer. The hard hat system includes a face shield assembly including a lens having an upper edge, an interior surface, and an exterior surface, and a hinge coupled to the hard hat and to the lens. The hinge is configured to actuate the lens between a lowered position and a raised position such that, when in the lowered position, the lens is at least partially below the brim and the interior surface of the lens faces toward the head of the wearer and the exterior surface of the lens faces away from the head of the wearer and, when in the raised position, the lens is at least partially above the brim. The hard hat system includes a flexible gasket coupled to the upper edge of the lens and extending toward the shell of the hard hat. When the lens is actuated between the lowered position and the raised position, the flexible gasket maintains continuous contact with the upper edge of the lens and with an outer surface of the shell of the hard hat above the brim such that the flexible gasket limits particulate matter from passing between the upper edge of the lens and the shell of the hard hat and toward the interior surface of the lens.

Another embodiment of the invention relates to a hard hat system including a hard hat having a brim and a shell formed from a rigid material. The hard hat is configured to receive a head of a wearer. The hard hat system includes a face shield assembly including a lens having an upper edge, an interior surface, and an exterior surface, and a hinge coupled to the hard hat and to the lens. The hinge is configured to actuate the lens between a lowered position and a raised position such that, when in the lowered position, the lens is at least partially below the brim and the interior surface of the lens faces toward the head of the wearer and the exterior surface of the lens faces away from the head of the wearer and, when in the raised position, the lens is at least partially above the brim. The hard hat system includes a gasket including a flexible gasket filler extending from the upper edge of the lens toward the shell of the hard hat and a lip extending along the upper edge of the lens and coupling the flexible gasket filler to the lens. When the lens is actuated between the lowered position and the raised position, the upper edge of the lens is spaced away from the shell of the hard hat forming a gap between the upper edge of the lens and the shell of the hard hat. The gasket extends across the gap between the upper edge of the lens and the shell of the hard hat when the lens is actuated between the lowered position and the raised position such that the gasket seals the gap.

Another embodiment of the invention relates to a hard hat system including a hard hat having a brim and a shell formed from a rigid material. The hard hat is configured to receive a head of a wearer. The hard hat system includes a face shield assembly including a lens having an upper edge, an interior surface, and an exterior surface, a face shield frame coupled to the lens, a brim mount coupled to the face shield frame and the brim of the hard hat, and a hinge coupled to the face shield frame and the brim mount. The hinge is configured to actuate the lens between a lowered position and a raised position such that, when in the lowered position, the lens is at least partially below the brim and the interior surface of the lens faces toward the head of the wearer and the exterior surface of the lens faces away from the head of the wearer and, when in the raised position, the lens is at least partially above the brim. The hinge includes a pivot axis defining an axial direction. The hinge is configured to rotate the lens about the pivot axis. The hinge includes a pivot projection having a pivot wing extending radially away from the pivot axis, and a pivot receiver having a slot opening configured to receive and release the pivot wing when the pivot wing and slot opening are aligned, and a slot configured to allow the pivot wing to rotate about the pivot axis within the pivot receiver when the pivot wing is received within the slot opening. When the face shield assembly is coupled to the hard hat, the shell of the hard hat restricts the pivot projection from rotating into a position where the pivot wing and the slot opening are aligned.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a face shield configured to attach to a hard hat or protective helmet are shown. Hard hats or protective helmets may be used in a variety of construction jobs or other situations. In some conventional face shield systems, the face shield can pivot away from the front of the face of the user. However, Applicant has identified that pivoting the face shield in this way can create a gap or space between the face shield and a brim or external surface of the hard hat or protective helmet. Applicant has identified that such a gap can allow dust or debris that has accumulated on the brim of the hard hat or protective helmet to enter the space between the user's face and the inside of the face shield.

In contrast, the face shield systems discussed herein utilize structures that act to block, capture, or control debris or dust that would otherwise accumulate on the brim of the hard hat or protective helmet. These face shield systems provide various advantages over typical hard hat face shield systems, including preventing (possibly all) debris or dust from passing into the space between a user's face and the inside of the face shield when pivoting the face shield.

Figure 1:
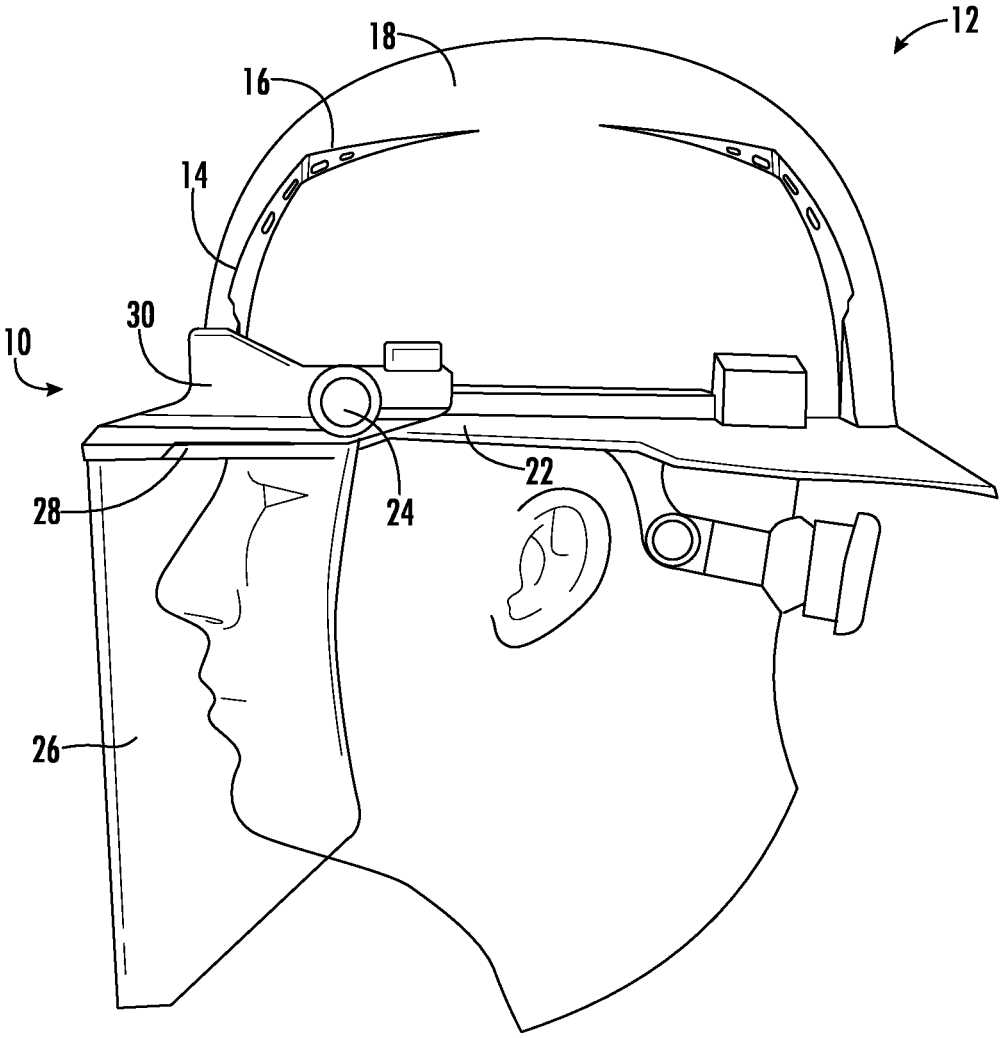
FIG. 1 is a side view of a hard hat with a face shield assembly including a gasket with a face shield in a lowered operating position, according to an exemplary embodiment.
Figure 2:
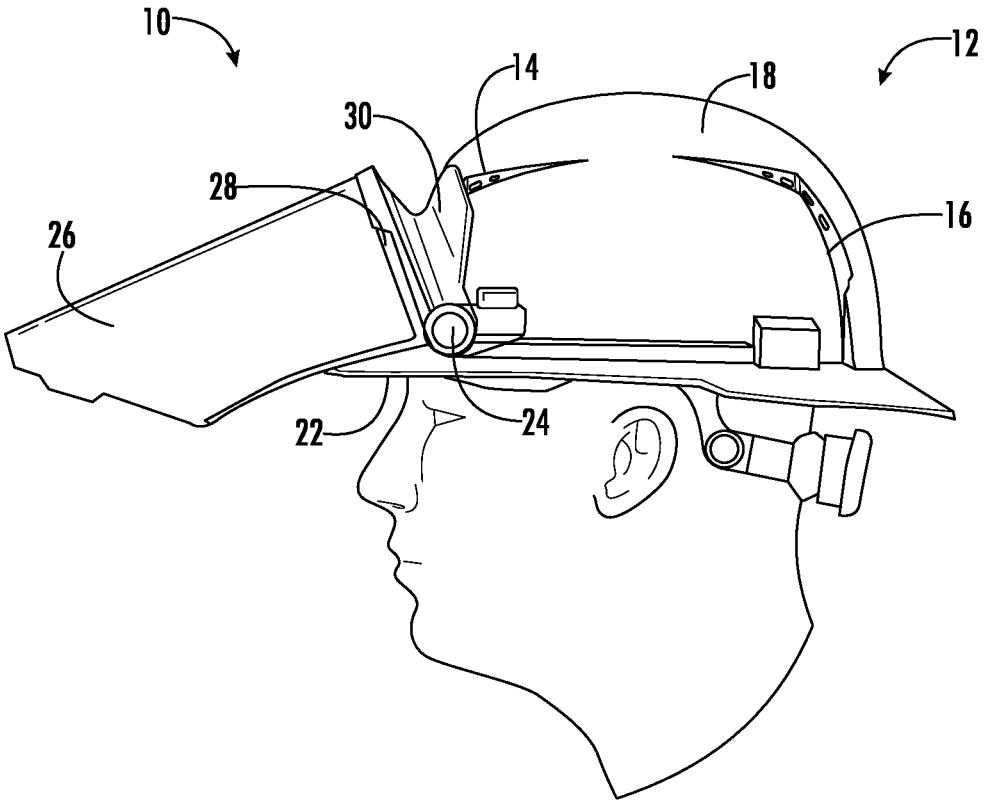
FIG. 2 is a side view of the hard hat of FIG. 1 with the face shield in a raised stowed position, according to an exemplary embodiment.
Figure 3:
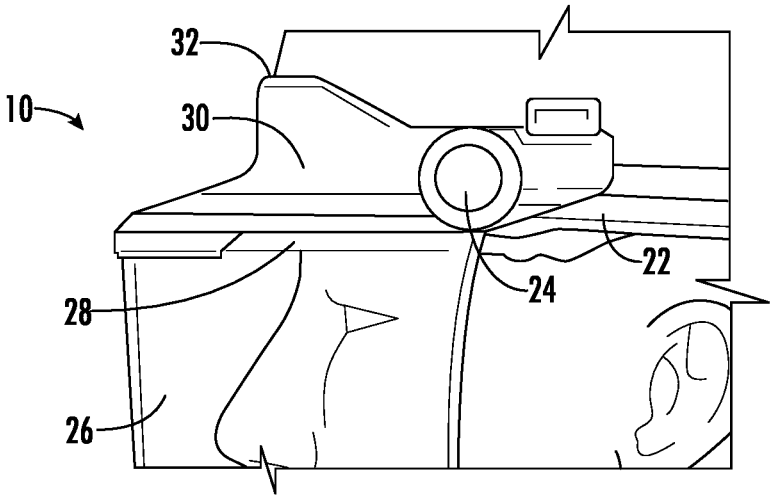
FIG. 3 is a detailed view of the face shield assembly of the hard hat of FIG. 1, according to an exemplary embodiment.

Referring to FIGS. 1-3, a face shield assembly 10 coupled to a hard hat 12 is shown according to an exemplary embodiment. As illustrated, hard hat 12 is oriented in a forward-facing direction with a brim 22 at a front end 14 of hard hat 12 and a crown segment 18 adjacent to and above brim 22. Hard hat 12 includes an outer shell formed from a rigid material, such as a rigid polymer material. Hard hat 12 includes an external surface 16.

In various embodiments, face shield assembly 10 includes a hinge 24 and a lens 26. Hinge 24 pivotally attaches lens 26 to hard hat 12. Lens 26 pivots between a lowered operating position (as shown in FIG. 1) and a raised stowed position (as shown in FIG. 2). Lens 26 includes an upper edge 28. When lens 26 is actuated to the stowed position or transitioning between the operating position and the stowed position, a gap or space may be created between upper edge 28 of lens 26 and external surface 16 of hard hat 12.

In a specific embodiment, face shield assembly 10 includes a gasket 30 that blocks or seals the gap that may otherwise be created between upper edge 28 of lens 26 and external surface 16 of hard hat 12. Gasket 30 couples to hinge 24 and to upper edge 28 of lens 26. Gasket 30 includes a gasket wiper 32 along an upper edge of gasket 30. Gasket wiper 32 contacts and glides along external surface 16 of hard hat 12 such that gasket 30 blocks dust or debris from entering the gap or space between upper edge 28 of lens 26 and external surface 16 of hard hat 12.

Gasket 30 is formed from a flexible material, such as rubber or other soft polymer material. Gasket 30 is capable of folding and unfolding when the distance between upper edge 28 of lens 26 and external surface 16 of hard hat 12 decreases or increases as lens 26 is actuated between the operating position and the stowed position. This structure prevents or limits dust or debris from entering the space between lens 26 and the user's face when transitioning lens 26 between the operating position and the stowed position by blocking the space between upper edge 28 of lens 26 and external surface 16 of hard hat 12 with gasket 30.

Referring to FIGS. 4-7, face shield assembly 110 is shown, according to an exemplary embodiment. Face shield assembly 110 is substantially similar to face shield assembly 10 except for the differences discussed herein. Face shield assembly 110 includes a gasket 130 that includes baffles 134. In various embodiments, baffles 134 are made from a rubber or other soft polymer material. Baffles 134 of gasket 130 form valleys and ridges along an external surface of gasket 130.

Figure 4:
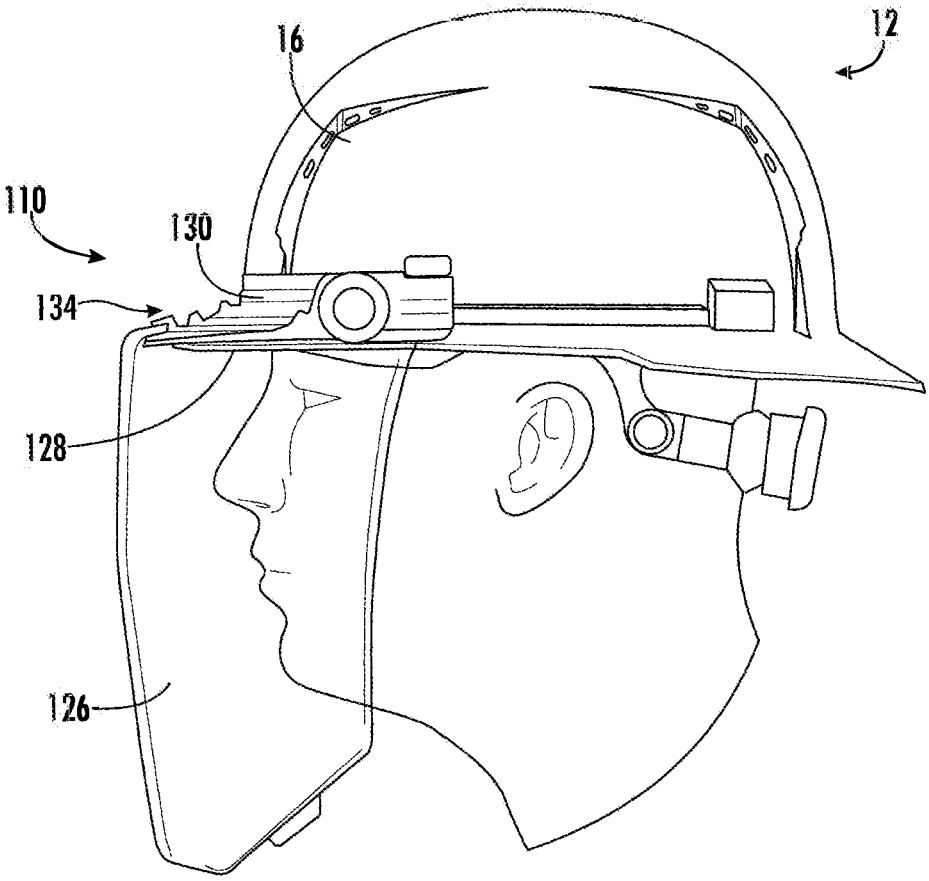
FIG. 4 is a side view of a hard hat with a face shield assembly including baffles with a face shield in a lowered operating position, according to an exemplary embodiment.
Figure 5:
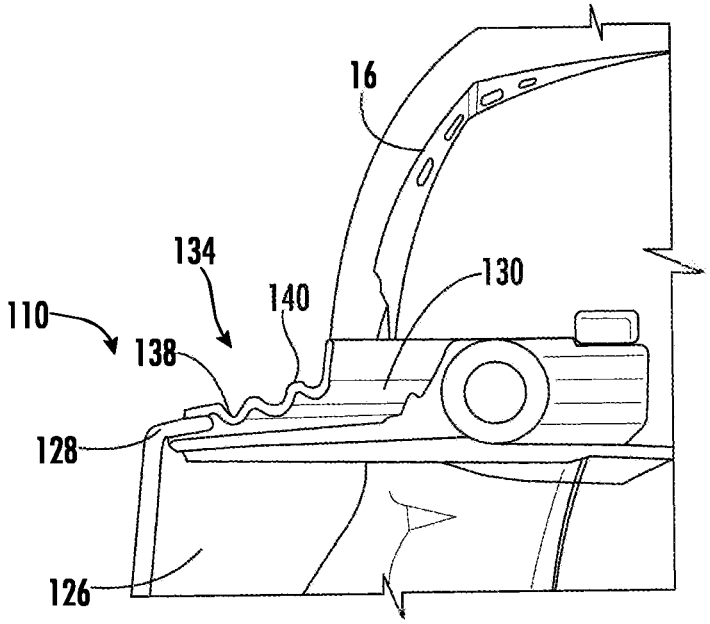
FIG. 5 is a detailed view of the face shield assembly of the hard hat of FIG. 4, according to an exemplary embodiment.
Figure 6:
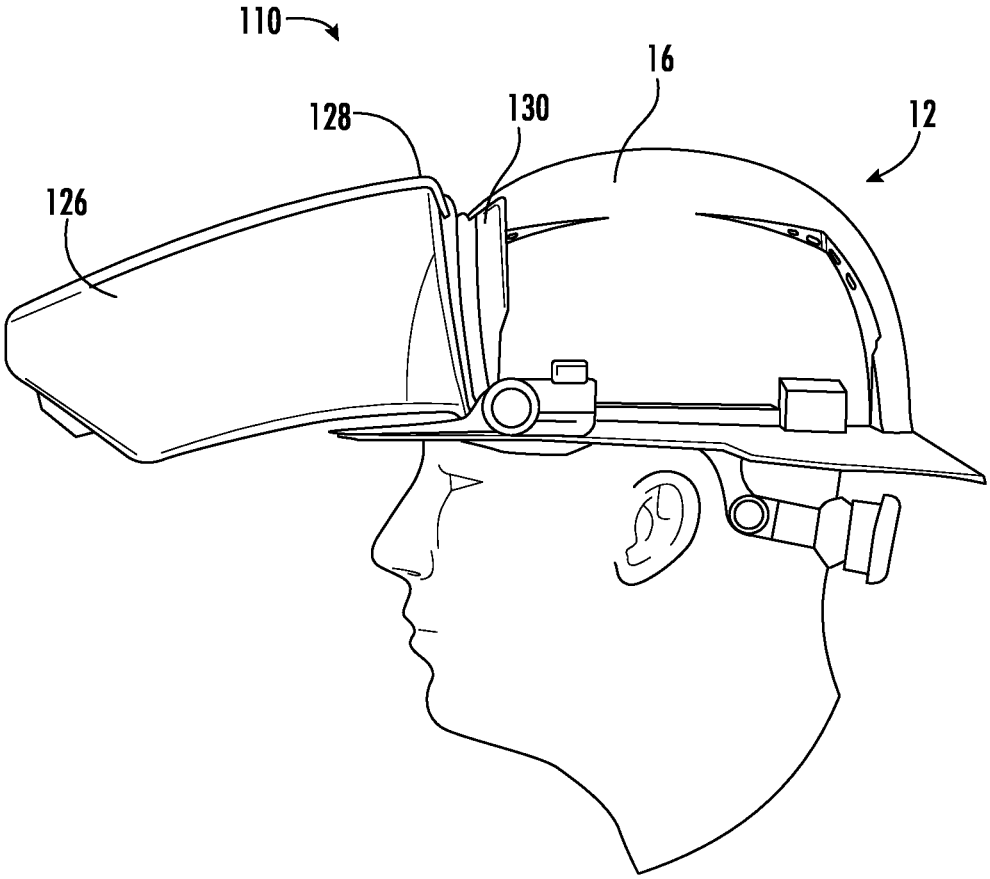
FIG. 6 is a side view of the hard hat of FIG. 4 with the face shield in a raised stowed position, according to an exemplary embodiment.
Figure 7:
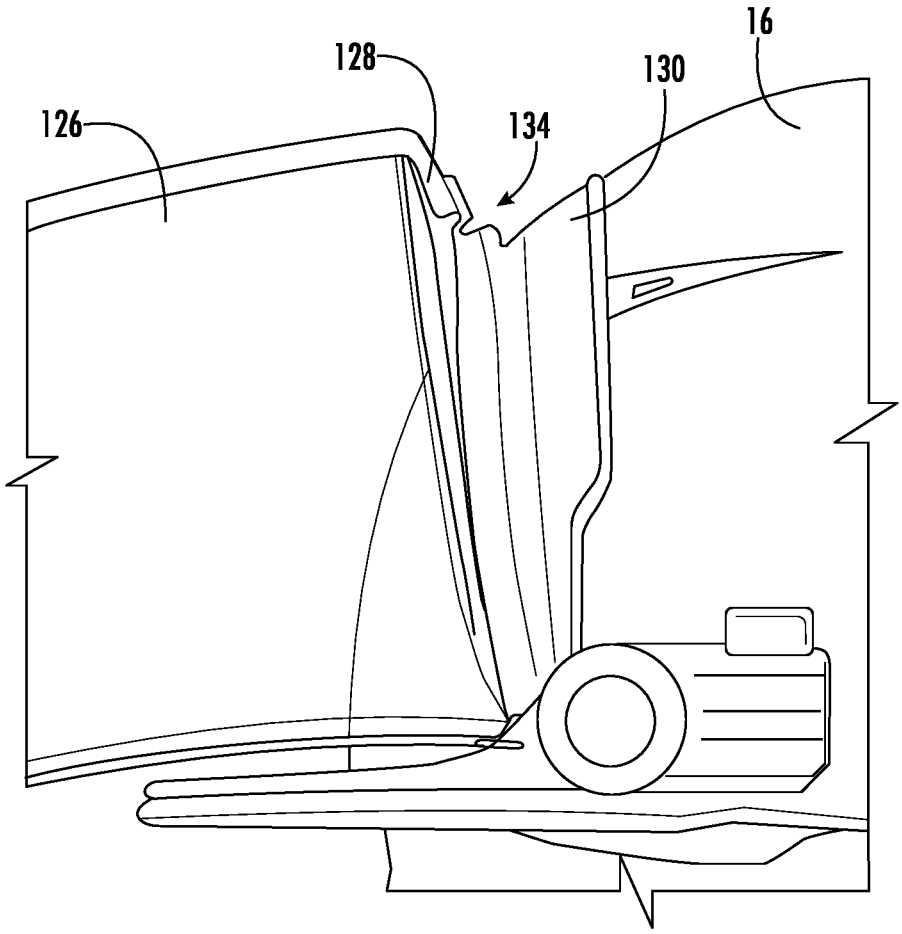
FIG. 7 is a detailed view of the face shield assembly of the hard hat of FIG. 6, according to an exemplary embodiment.
Figure 8:
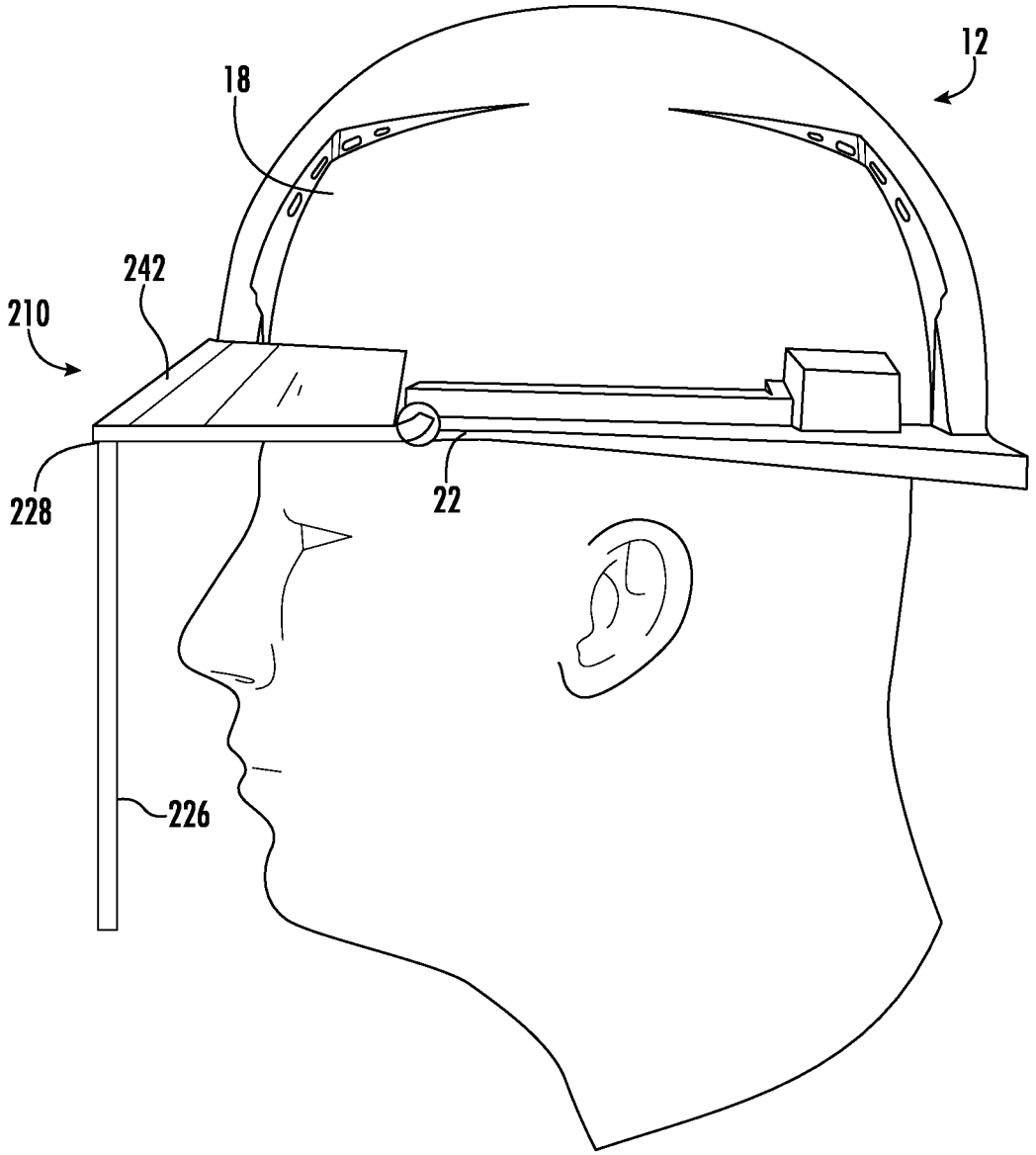
FIG. 8 is a side view of a hard hat with a face shield assembly including a brim ramp with a face shield in a lowered operating position, according to an exemplary embodiment.

In various embodiments, face shield assembly 110 includes a window shade style (boot or baffle) design that is flexible or collapsible when actuating lens 126 between a lowered operating position (as shown in FIGS. 4-5) and a raised stowed position (as shown in FIGS. 6-7). The design, shape, and/or material elasticity of baffles 134 bias lens 126 toward the operating position. In a specific embodiment, gasket 130 is coupled to external surface 16 of hard hat 12 such that gasket 130 provides an uninterrupted barrier between upper edge 128 of lens 126 and external surface 16 of hard hat 12. In this embodiment, the flexible or collapsible material of baffles 134 expands when lens 126 is in the stowed position and compresses when lens 126 is in the operating position. In an alternative embodiment, gasket 130 contacts and glides along external surface 16 of hard hat 12 such that gasket 130 blocks dust or debris from entering the gap or space between upper edge 128 of lens 126 and external surface 16 of hard hat 12. In this embodiment, the flexible or collapsible material of baffles 134 expand when lens 126 is in the operating position and compress when lens 126 is in the stowed position.

Referring to FIGS. 8-11, face shield assembly 210 is shown, according to an exemplary embodiment. Face shield assembly 210 is substantially similar to face shield assembly 10 except for the differences discussed herein. Face shield assembly 210 includes a brim ramp 242 at upper edge 228 of lens 226 that extends from crown segment 18 of hard hat 12 and over brim 22. Brim ramp 242 is wedge shaped such that dust or debris falls away from brim 22 and does not build up on brim 22.

Figure 9:
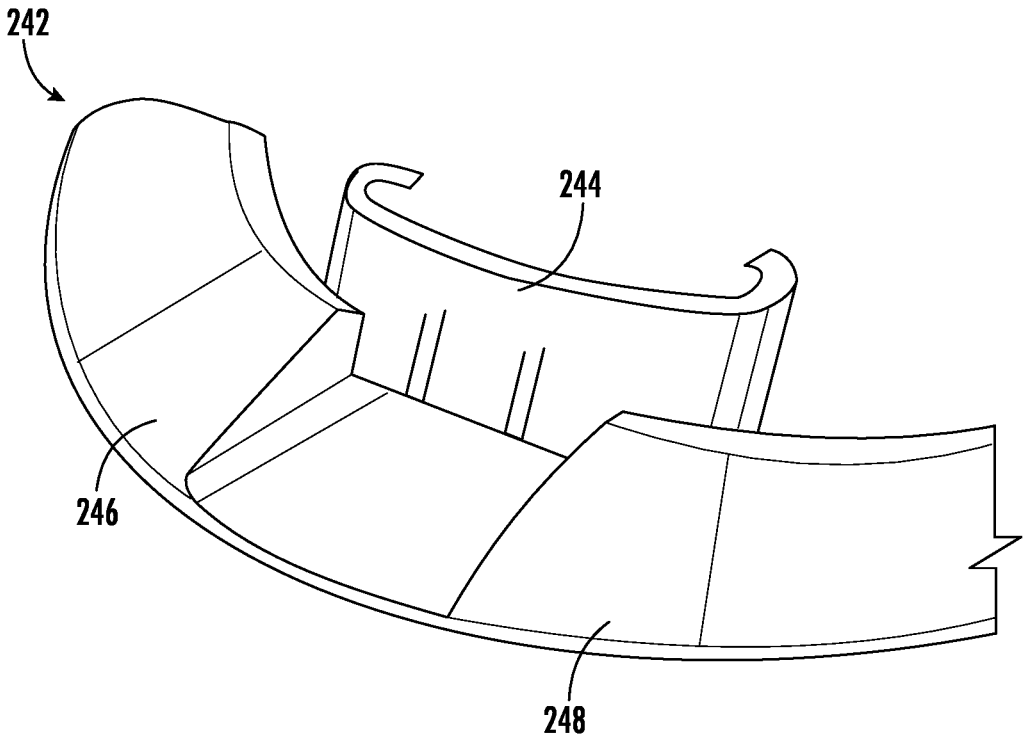
FIG. 9 is a detailed perspective view of the brim ramp of the hard hat of FIG. 8, according to an exemplary embodiment.

As shown in FIG. 9, brim ramp 242 can include multiple distinct brim ramp sections, such as a first brim ramp section 246 and a second brim ramp section 248. In a specific embodiment, brim ramp 242 is separate from face shield assembly 210 and attaches to a mounting clip or bracket 244. Mounting clip 244 is shaped to attach to a mounting location or mounting ridge of hard hat 12 such that brim ramp 242 attaches to and is supported from hard hat 12 in the desired location, such as over brim 22 and lens 226.

Figure 10:
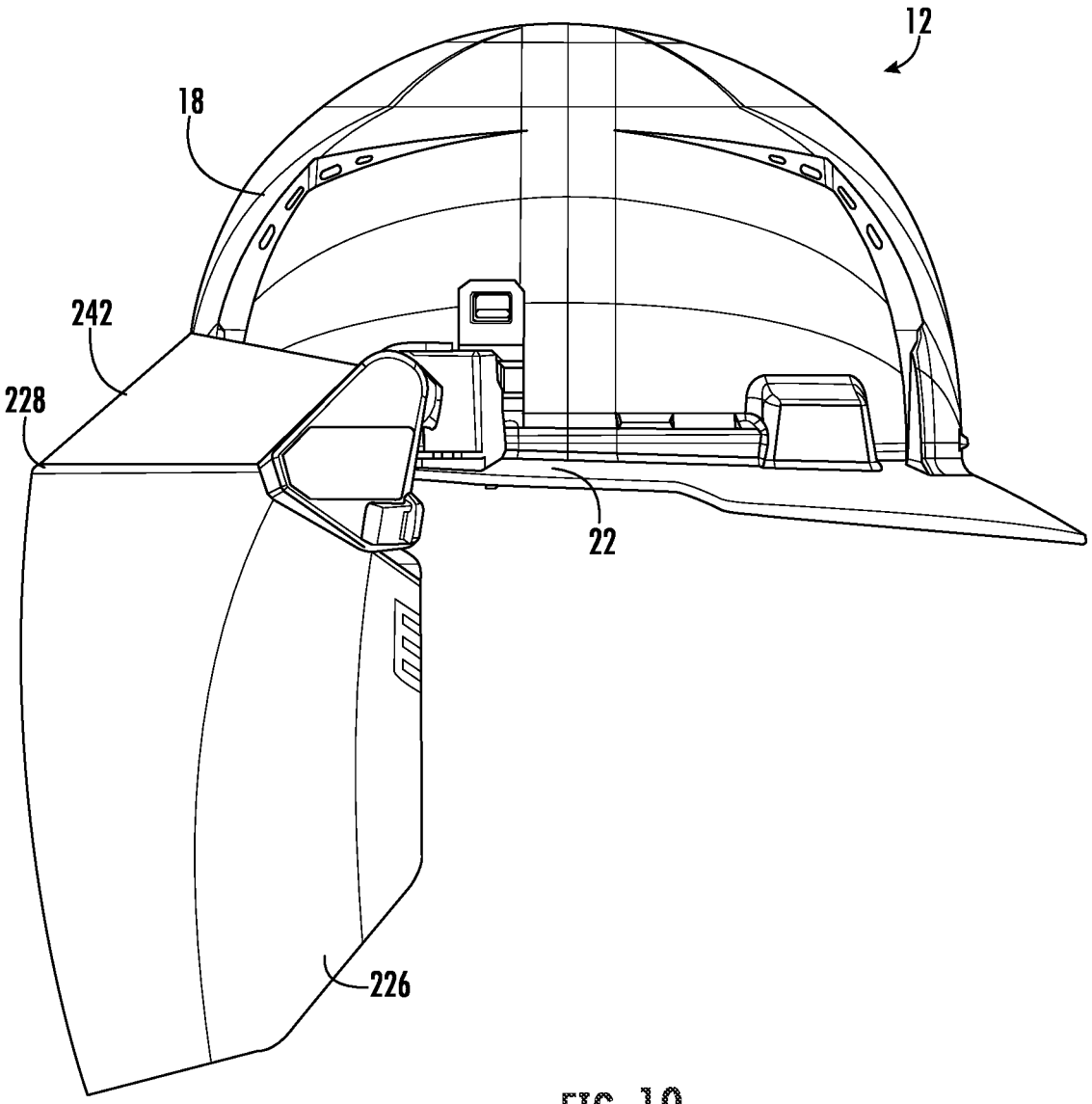
FIG. 10 is a side view of a hard hat with a face shield assembly including a brim ramp with a face shield in a lowered operating position, according to an exemplary embodiment.
Figure 11:
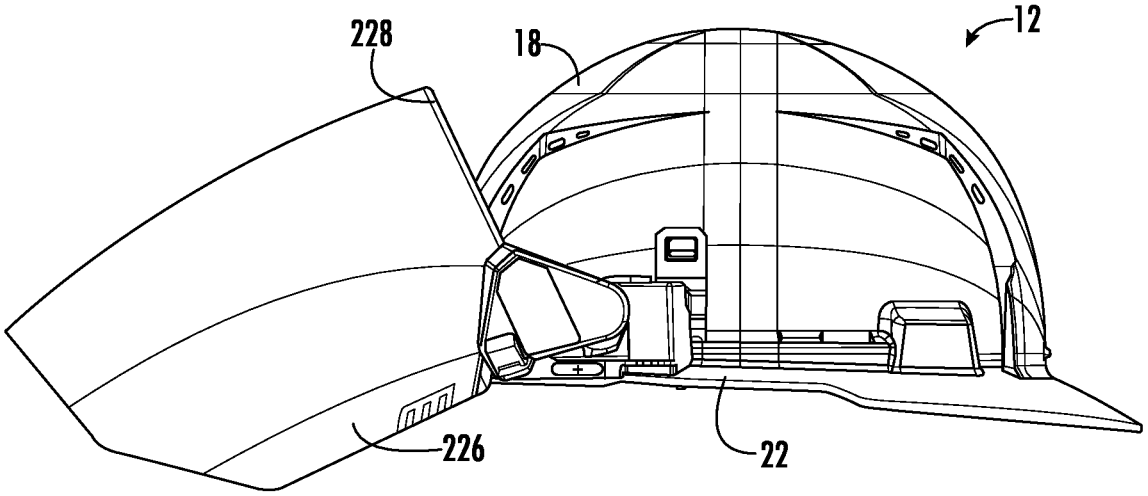
FIG. 11 is a side view of the hard hat of FIG. 10 with a face shield in a raised stowed position, according to an exemplary embodiment.

Referring to FIGS. 10 and 11, lens 226 can pivot between a lowered operating position (as shown in FIG. 10) and a raised stowed position (as shown in FIG. 11). Brim ramp 242 remains in the same position with respect to brim 22 when lens 226 is in the lowered operating position, the raised stowed position, or transitioning between positions. When lens 226 is in the lowered operating position, brim ramp 242 creates a seal between brim ramp 242 and upper edge 228 of lens 226 that prevents or limits dust or debris from falling between lens 226 and the user's face. Brim ramp 242 creates a seal between brim ramp 242 and crown segment 18 of hard hat 12 that prevents or limits dust or debris from falling behind brim ramp 242.

Figure 12:
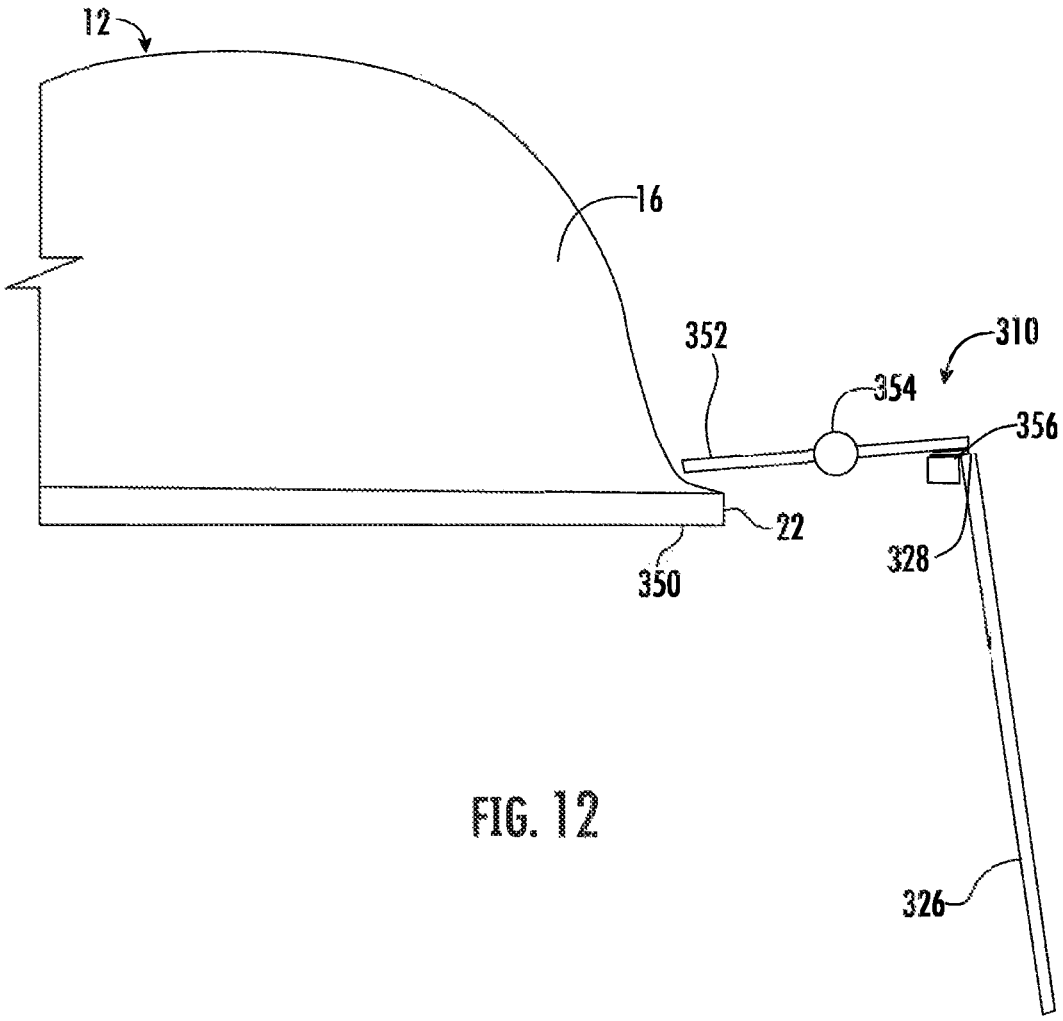
FIG. 12 is a side view of a hard hat with a face shield assembly including a detachable lens in an attached position, according to an exemplary embodiment.
Figure 13:
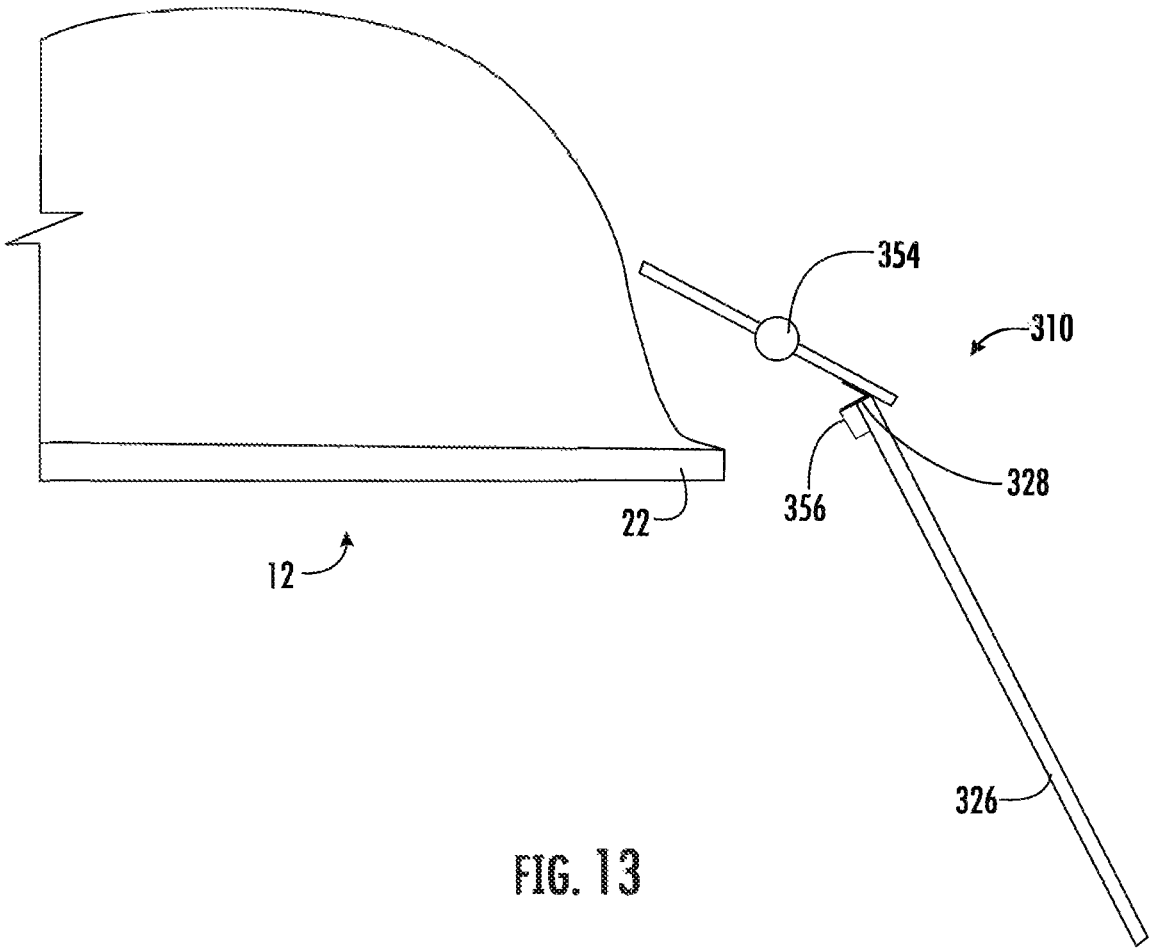
FIG. 13 is a side view of the hard hat of FIG. 12 with the detachable lens immediately following detachment, according to an exemplary embodiment.
Figure 14:
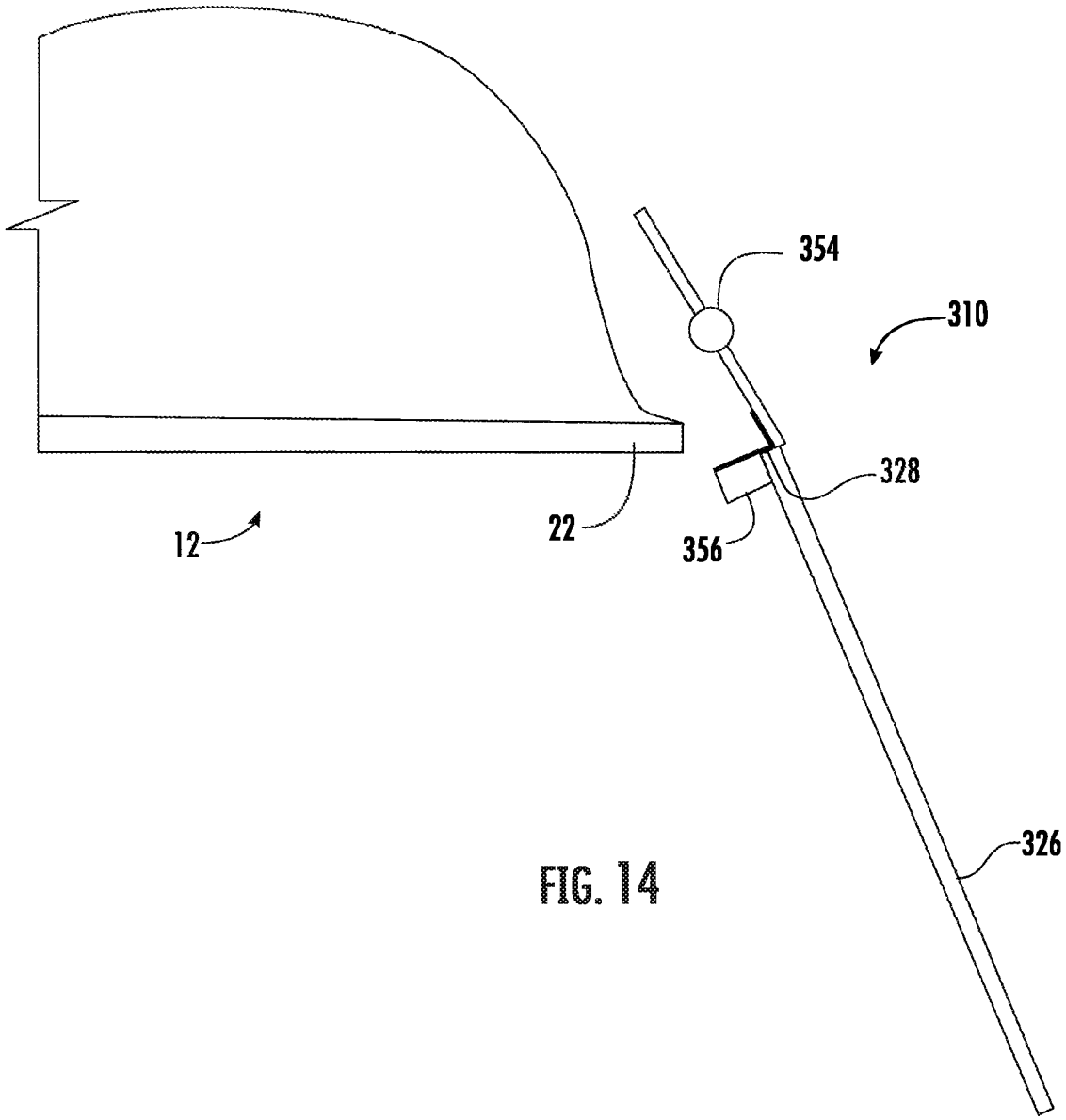
FIG. 14 is a side view of the hard hat of FIG. 12 with the detachable lens in a fully detached position, according to an exemplary embodiment.

Referring to FIGS. 12-14, face shield assembly 310 is shown, according to an exemplary embodiment. Face shield assembly 310 is substantially similar to face shield assembly 10 except for the differences discussed herein. Face shield assembly 310 includes a lens 326 that is detachable from hard hat 12. In this embodiment, face shield assembly 310 includes a mounting magnet 350 coupled to hard hat 12 and a lens magnet 352 coupled to lens 326 near an upper edge 328 of lens 326. Referring to FIG. 12, lens 326 magnetically attaches to hard hat 12 when lens magnet 352 is positioned near mounting magnet 350. Referring to FIG. 14, lens 326 detaches from hard hat 12 when force is applied to lens 326 sufficient to overcome the attractive forces between mounting magnet 350 and lens magnet 352. Alternatively, face shield assembly 310 can include a clip system to detachably attach lens 326 to hard hat 12.

Face shield assembly 310 includes a debris cup 354. Debris cup 354 is coupled to upper edge 328 of lens 326 such that debris cup 354 covers at least a portion of brim 22 when lens 326 is attached to hard hat 12. When lens 326 is detached from hard hat 12 and pulled away from the user's face, debris cup 354 is configured to carry away any dust or debris that accumulated in or on debris cup 354. This structure prevents or limits dust or debris from falling between the space or gap between upper edge 328 of lens 326 and external surface 16 of hard hat 12. In a specific embodiment, debris cup 354 is coupled to lens 326 by a cup hinge 356. Face shield assembly 310 includes a biasing element, such as a spring. Referring to FIG. 14, the biasing element rotates debris cup 354 when lens 326 is detached from hard hat 12 such that debris or dust accumulated on debris cup 354 is expelled from face shield assembly 310 on a side of lens 326 opposite the user's face.

Figure 15:
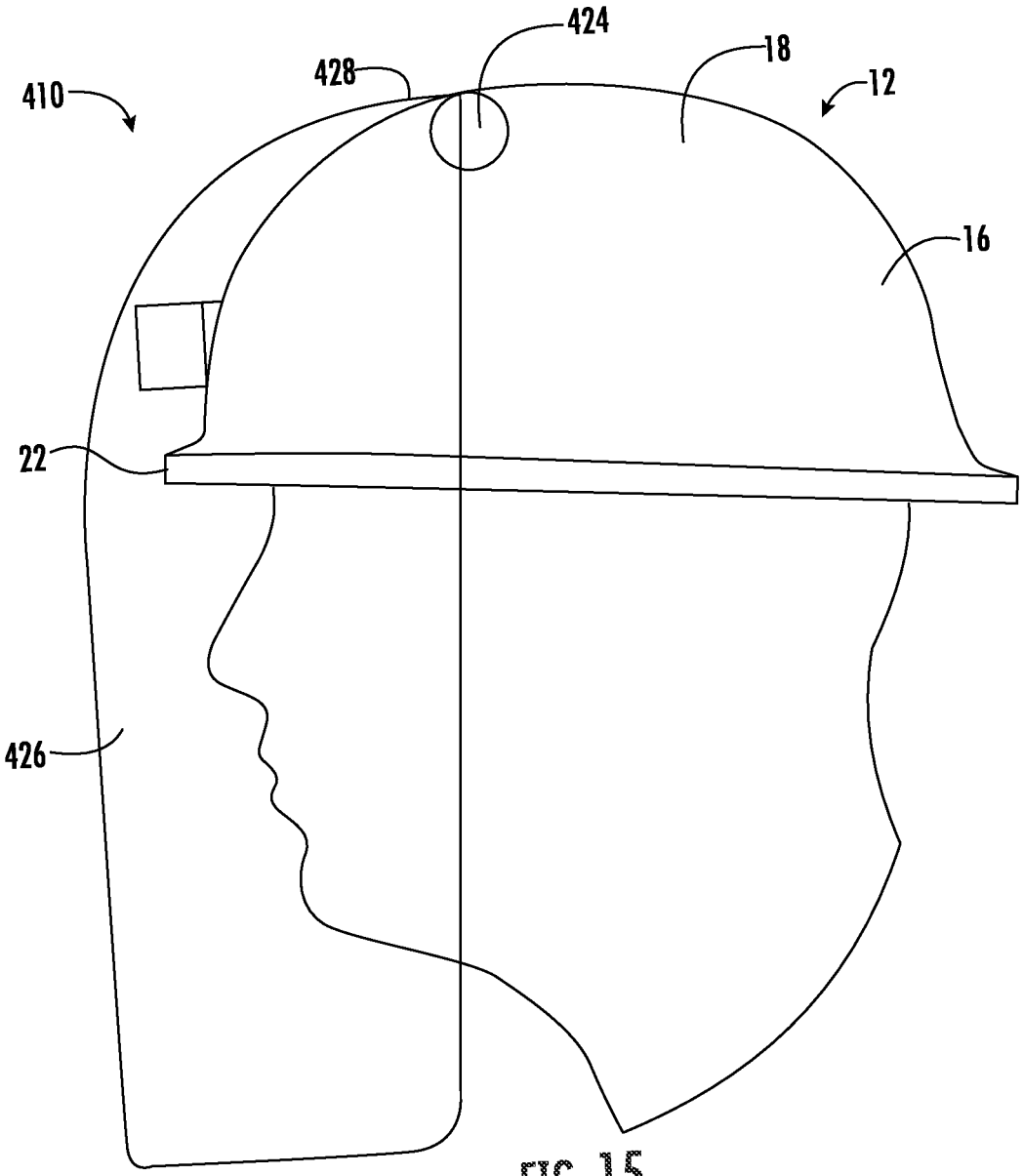
FIG. 15 is a side view of a hard hat with a face shield assembly in a lowered operating position including a lens extending over a brim of the hard hat, according to an exemplary embodiment.
Figure 16:
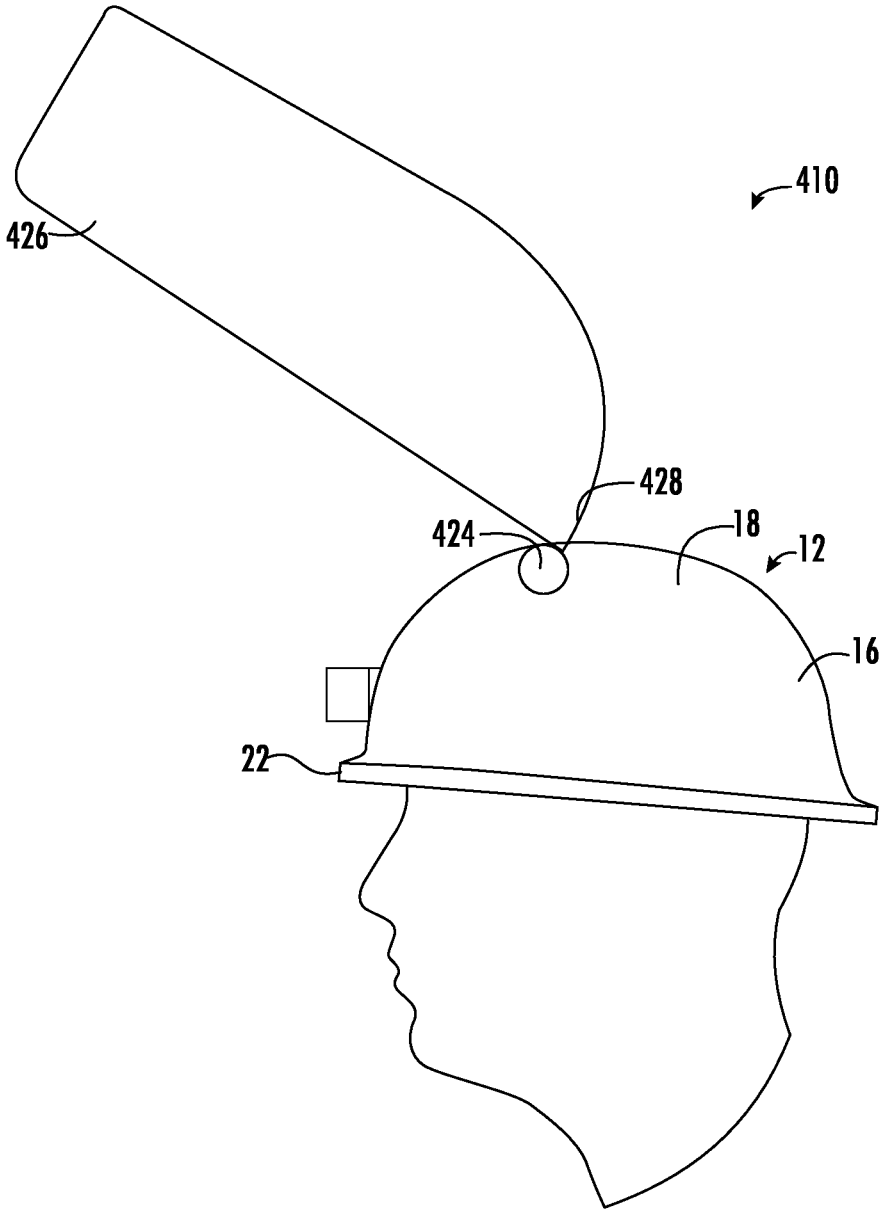
FIG. 16 is a side view of the hard hat of FIG. 15 with the face shield assembly in a raised stowed position, according to an exemplary embodiment.
Figure 17:
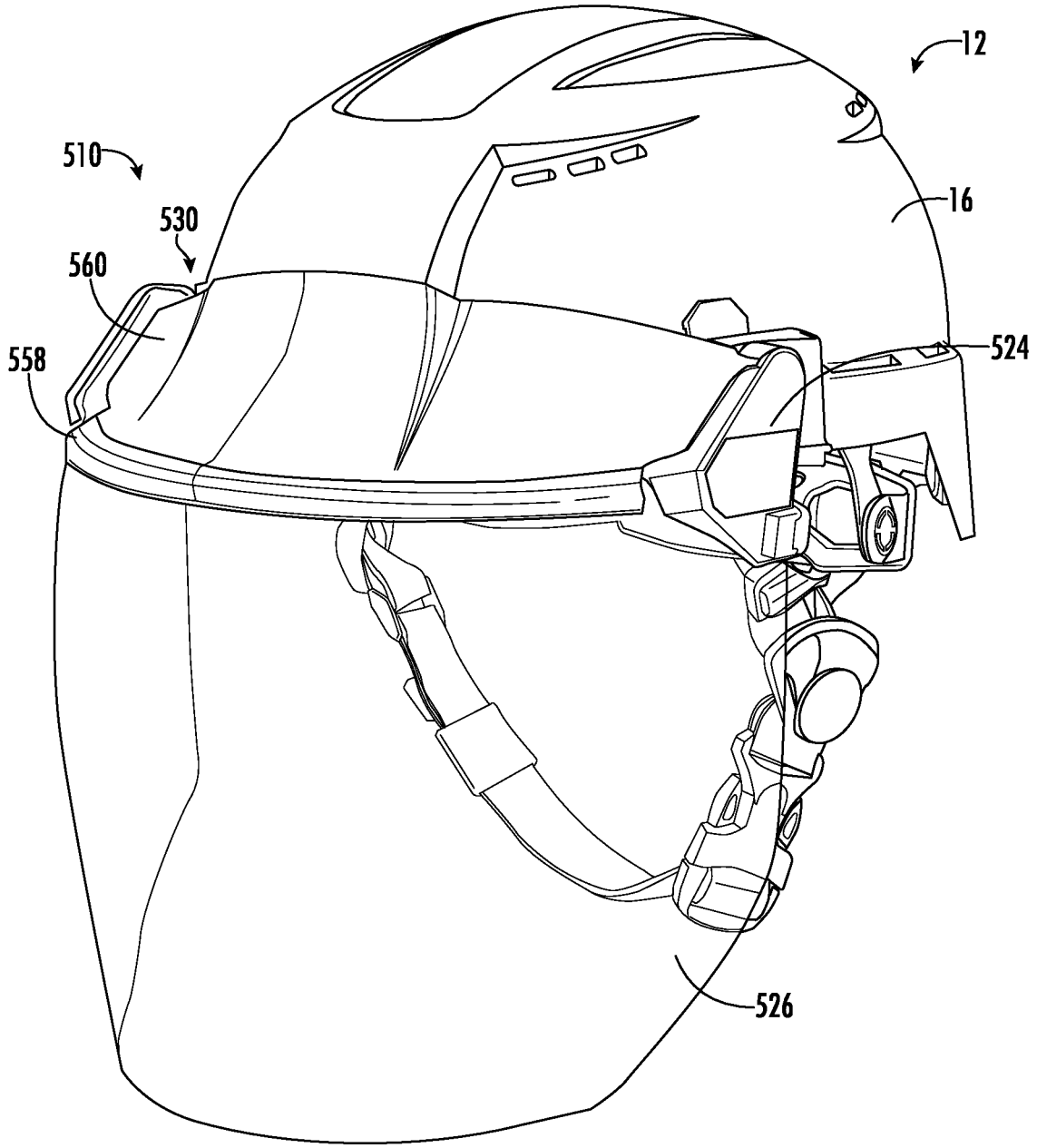
FIG. 17 is a perspective view of a hard hat with a face shield assembly including a gasket with a face shield in a lowered operating position, according to an exemplary embodiment.

Referring to FIGS. 15 and 16, face shield assembly 410 is shown, according to an exemplary embodiment. Face shield assembly 410 is substantially similar to face shield assembly 10 except for the differences discussed herein. Face shield assembly 410 includes a lens 426 and a hinge 424. Hinge 424 pivotally attaches lens 426 to hard hat 12. In a specific embodiment, hinge 424 is attached to crown segment 18 of hard hat 12. Hinge 424 attaches to the center of an upper edge 428 of lens 426 such that a gap or space between upper edge 428 of lens 426 and external surface 16 of hard hat 12 is minimized. This structure prevents or limits dust or debris from falling between lens 426 and the user's face when actuating lens 426 between a lowered operating position (as shown in FIG. 15) and a raised stowed position (as shown in FIG. 16).

Referring to FIG. 15, lens 426 extends substantially over brim 22 when lens 426 is in the operating position. Lens 426 blocks dust or debris from accumulating on brim 22, reducing the amount of dust or debris that falls onto the user's face when actuating lens 426 between the operating position and the stowed position. Lens 426 has a curvature such that dust or debris falls away from lens 426 when in the operating position and does not accumulate thereon.

Referring to FIGS. 17-21, face shield assembly 510 is shown, according to an exemplary embodiment. Face shield assembly 510 is substantially similar to face shield assembly 10 except for the differences discussed herein. Face shield assembly 510 includes a hinge 524, a lens 526, and a gasket 530 that includes a lip 558 and a shell 560. In a specific embodiment, lip 558 is formed from a first plastic material and shell 560 is formed from a second plastic material. In a specific embodiment, shell 560 is over-molded on lip 558. Shell 560 and lip 558 are contoured to the shape of hard hat 12 such that gasket 530 slides along the external surface 16 of hard hat 12 when lens 526 actuates between the operating position and the stowed position. This structure prevents or limits dust or debris from entering the space between lens 526 and the user's face when transitioning lens 526 between the operating position and the stowed position by blocking the space between upper edge 528 of lens 526 and external surface 16 of hard hat 12 with gasket 530.

Figure 18:
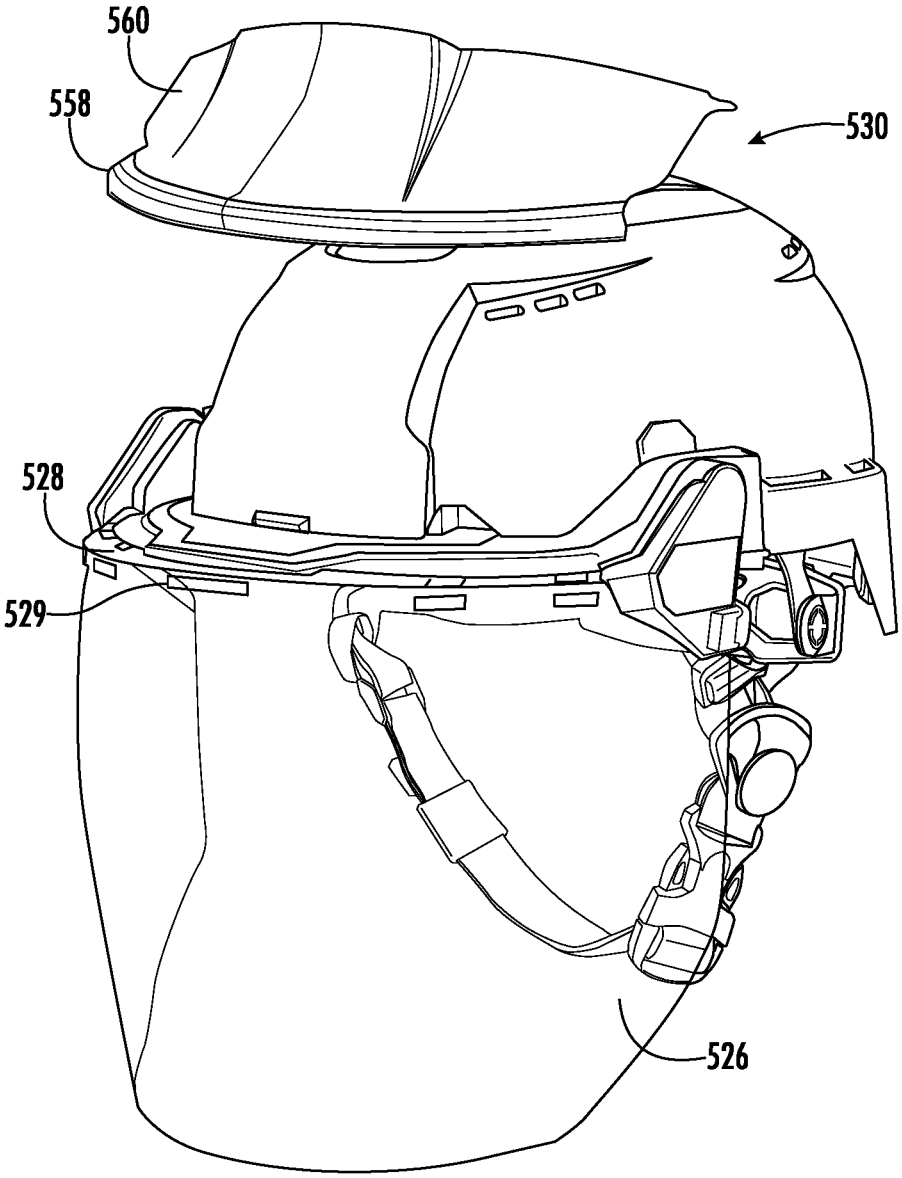
FIG. 18 is an exploded view of the hard hat and face shield assembly of FIG. 17, according to an exemplary embodiment.
Figure 19:
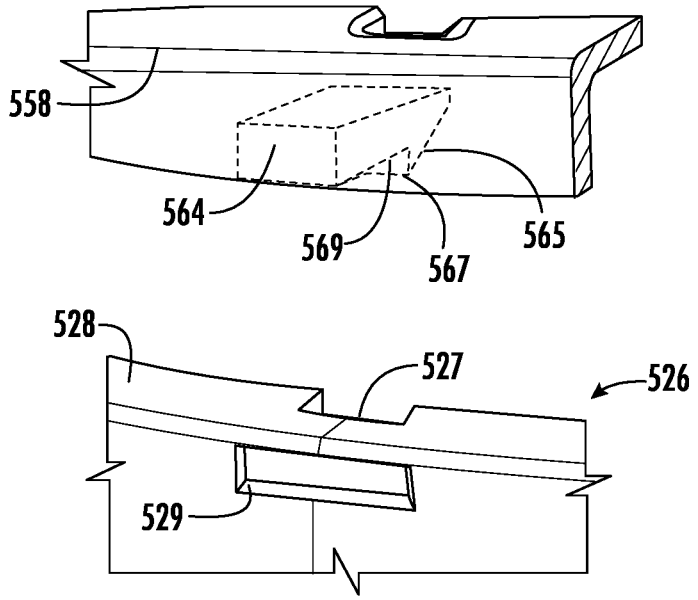
FIG. 19 is a detailed exploded view of the face shield assembly of FIG. 17, according to an exemplary embodiment.
Figure 20:
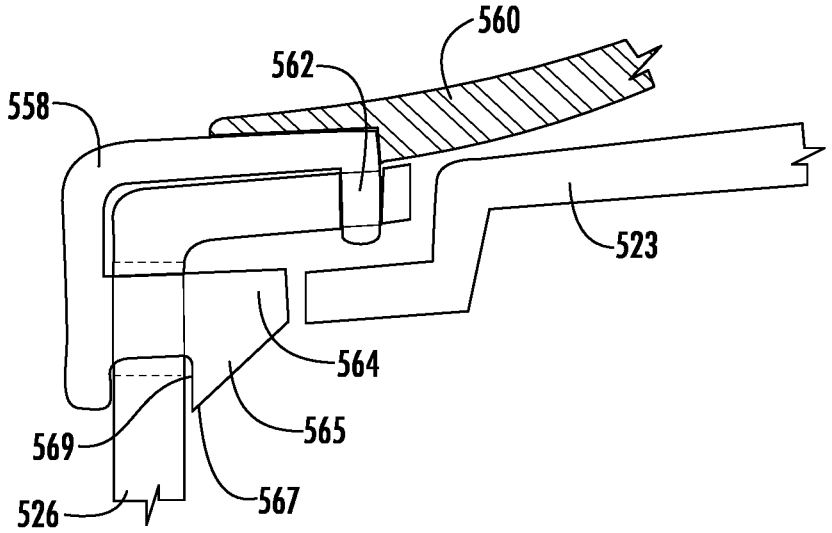
FIG. 20 is a cross-sectional view of the face shield assembly of FIG. 17, according to an exemplary embodiment.

Referring to FIGS. 18-20, lens 526 includes a plurality of notches 527 along upper edge 528 of lens 526 and a plurality of apertures 529 located below upper edge 528. Lip 558 includes a plurality of tabs 562 and snap-fit legs 564 that extend from lip 558. Tabs 562 fit into and engage with notches 527 to securely attach lip 558 to lens 526. Similarly, snap-fit legs 564 fit into apertures 529 to securely attach lip 558 to lens 526. Snap-fit legs 564 also include ribs 565. In one embodiment, ribs 565 extend from a side of snap-fit legs 564 and taper in a direction away from snap-fit legs 564 to a point 567. Ribs 565 include a rib surface 569 along a side of ribs 565 that further secures lip 558 to lens 526 by engaging an interior surface of lens 526. In some embodiments, shell 560 also includes apertures that snap-fit legs 564 extend through such that shell 560 is coupled to lip 558 via snap-fit legs 564.

Figure 21:
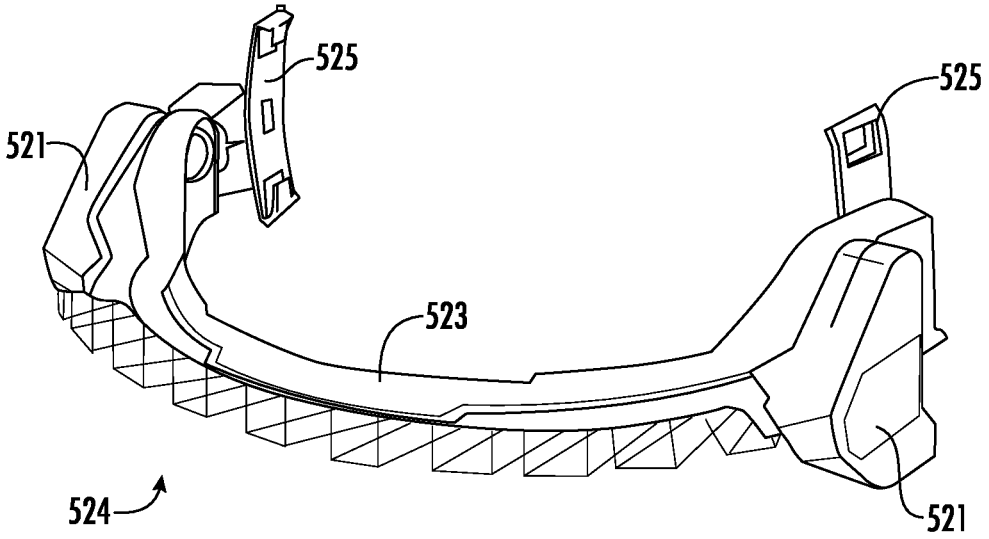
FIG. 21 is a detailed perspective view of a hinge of the face shield assembly of FIG. 17, according to an exemplary embodiment.
Figure 22:
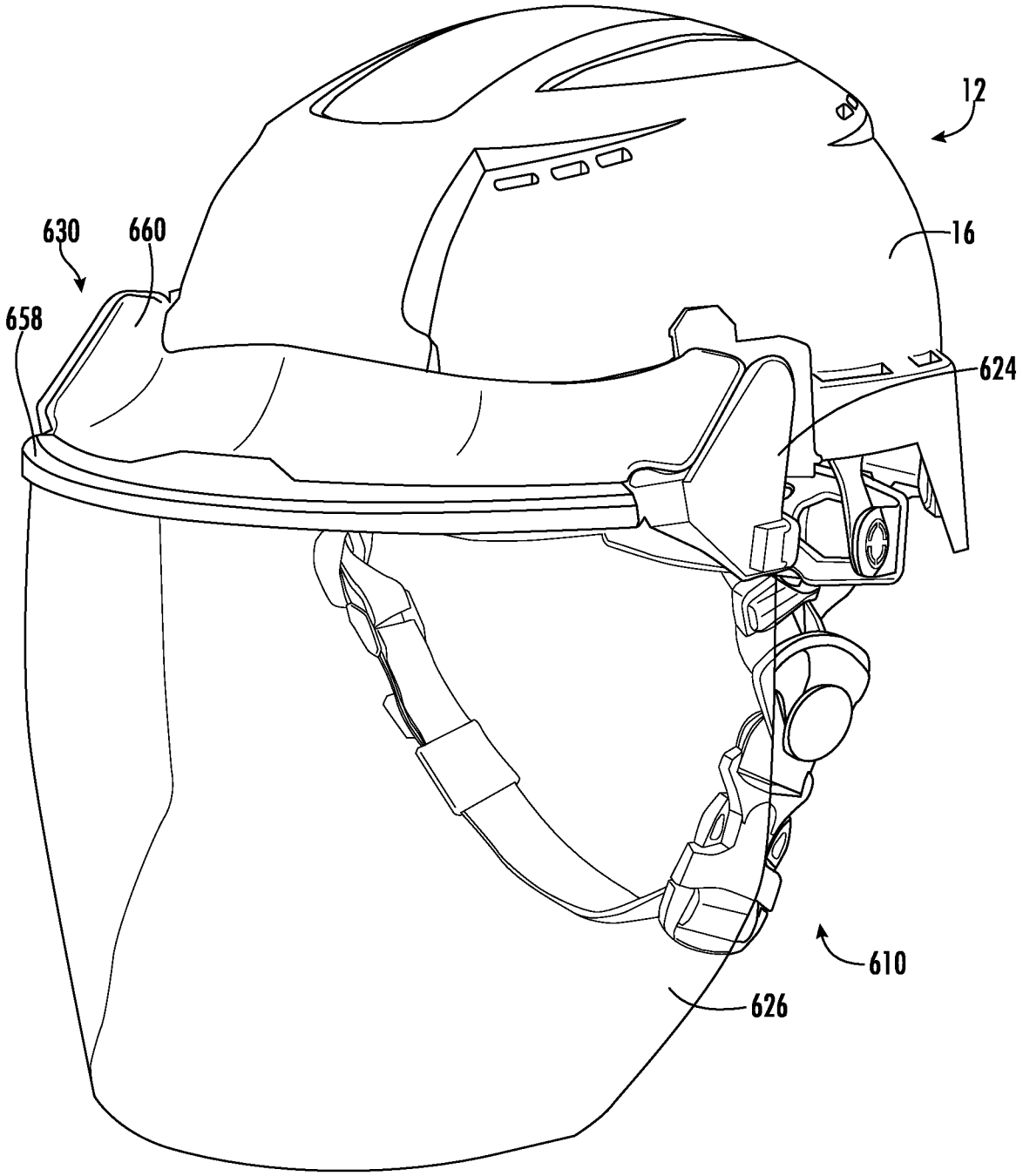
FIG. 22 is a perspective view of a hard hat with a face shield assembly including a gasket with a face shield in a lowered operating position, according to an exemplary embodiment.
Figure 23:
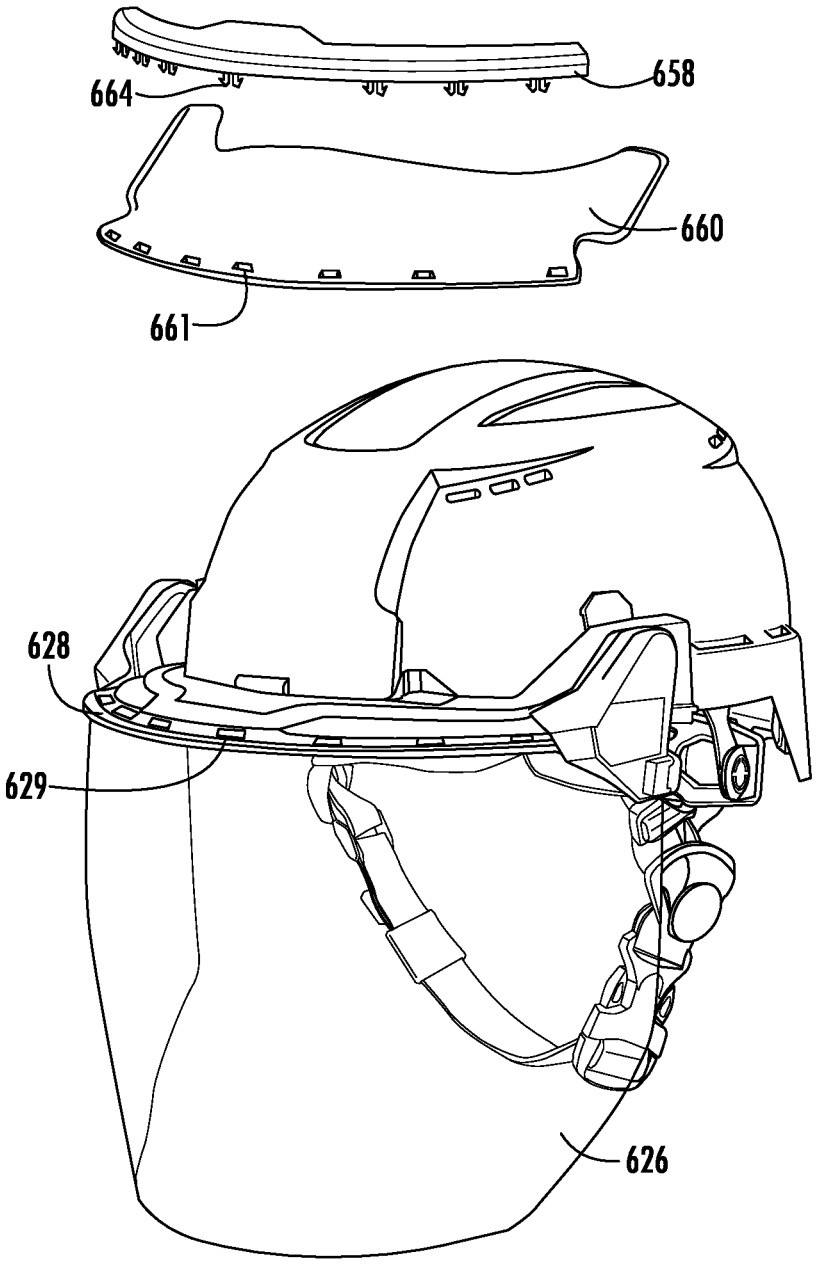
FIG. 23 is an exploded view of the hard hat and face shield assembly of FIG. 22, according to an exemplary embodiment.

Referring to FIG. 21, hinge 524 includes hinge joints 521, a bridge 523, and hinge mounting brackets 525. Hinge mounting brackets 525 couple hinge 524 to hard hat 12. Bridge 523 couples hinge joints 521 to each other and couples lens 526 and gasket 530 to hinge 524. As shown in FIG. 20, gasket 530 overlays bridge 523 such that a portion of lens 526 is located between gasket 530 and bridge 523.

Referring to FIGS. 22-25, face shield assembly 610 is shown, according to an exemplary embodiment. Face shield assembly 610 is substantially similar to face shield assembly 510 except for the differences discussed herein. Face shield assembly 610 includes a lens 626 and a gasket 630. In this embodiment, lens 626 includes a plurality of lens apertures 629 along an upper edge 628. Gasket 630 includes a lip 658 and shell 660. Gasket 630 is coupled to upper edge 628 of lens 626 and extends toward external surface 16 of hard hat 12. Shell 660 is a gasket filler for gasket 630 and extends between upper edge 628 of lens 626 and external surface 16 of hard hat 12. Shell 660 includes a plurality of gasket or shell apertures 661 that are configured to align with lens apertures 629. Lip 658 extends along upper edge 628 of lens 626. Lip 658 couples shell 660 to lens 626.

Figure 24:
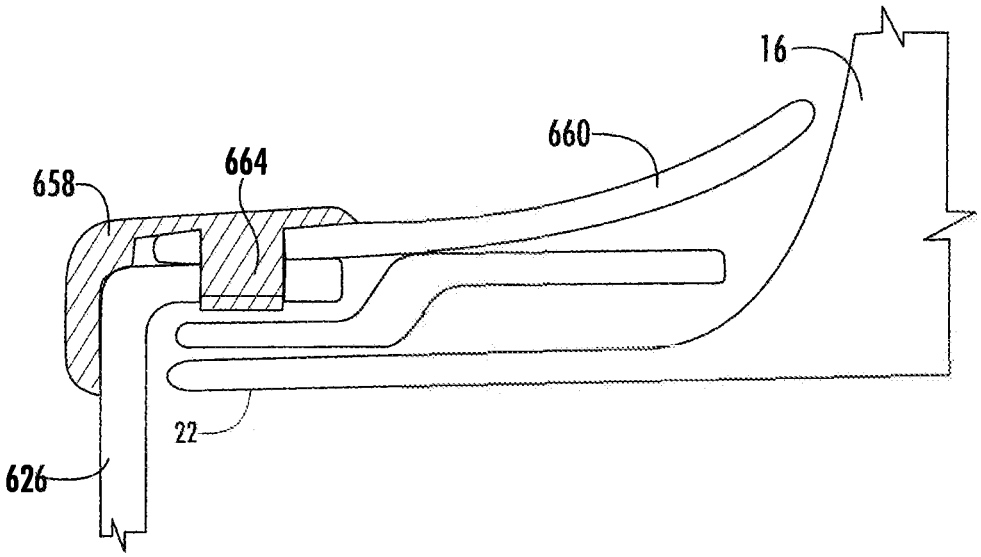
FIG. 24 is a cross-sectional view of the face shield assembly of FIG. 22, according to an exemplary embodiment.
Figure 25:
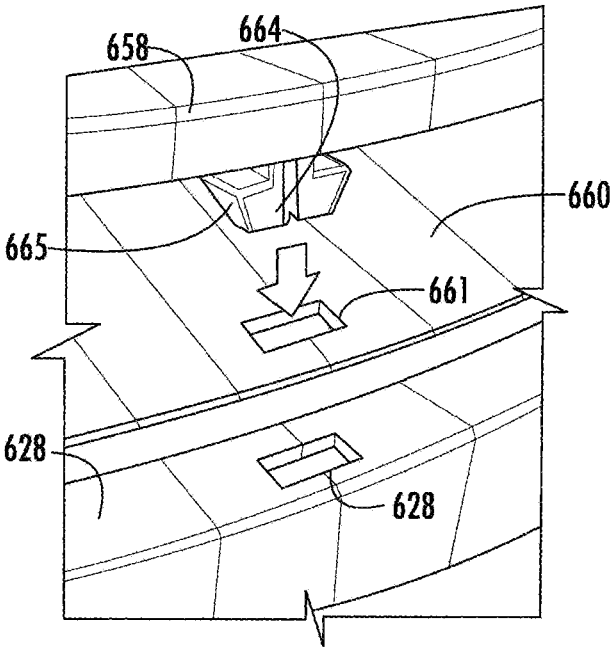
FIG. 25 is a detailed perspective view of the face shield assembly of FIG. 22, according to an exemplary embodiment.
Figure 26:
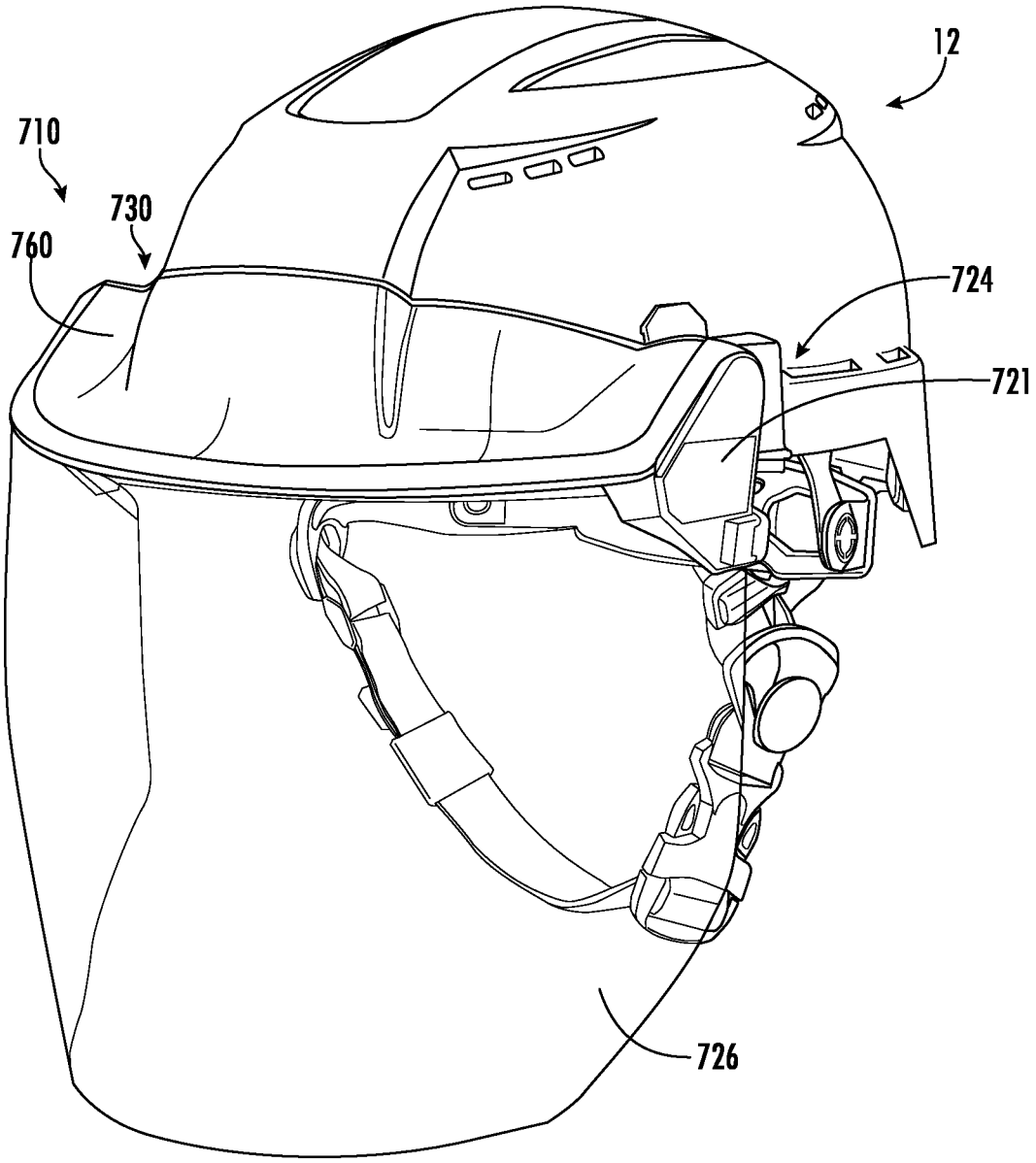
FIG. 26 is a perspective view of a hard hat with a face shield assembly including a gasket with a face shield in a lowered operating position, according to an exemplary embodiment.
Figure 27:
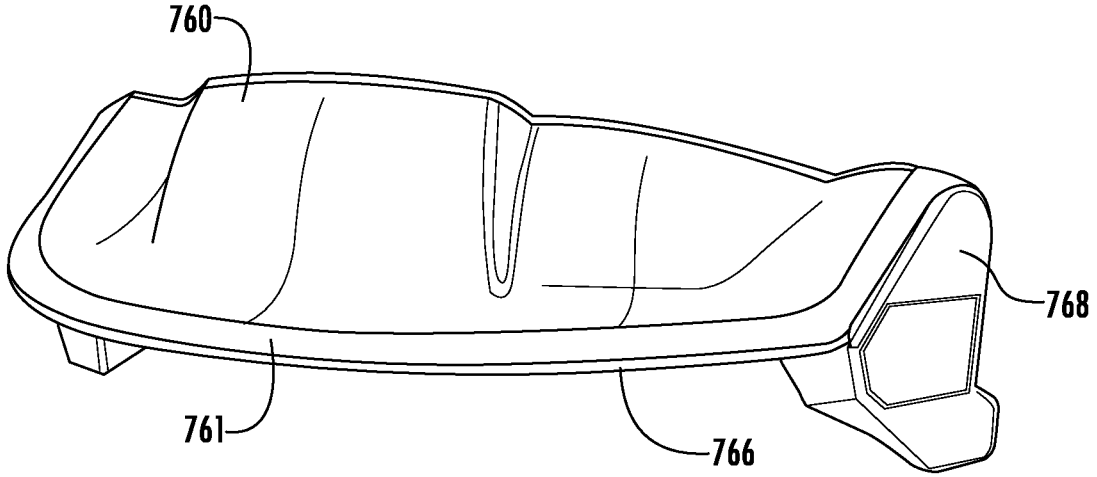
FIG. 27 is a detailed perspective view of the gasket of the face shield assembly of FIG. 26, according to an exemplary embodiment.

Referring to FIGS. 24 and 25, lip 658 is coupled to lens 626 and shell 660 by a plurality of snap-fit legs 664 extending from a bottom surface of lip 658 in the direction of lens 626. Snap-fit legs 664 extend in a direction substantially perpendicular to the bottom surface of lip 658. In a specific embodiment, snap-fit legs 664 extend away from the bottom surface of lip 658 at an angle of between 85 degrees and 95 degrees with respect to the bottom surface of lip 658. Snap-fit legs 664 include ribs 665. In a specific embodiment, the snap-fit legs 664 of lip 658 are arranged in pairs along a bottom surface of lip 658 such that two snap-fit legs 664 having ribs 665 oriented in opposite directions extend into each lens aperture 629 and shell aperture 661. The lens apertures 629 and shell apertures 661 are aligned such that the pairs of snap-fit legs 664 each extend through both a lens aperture 629 and a shell aperture 661. Lip 658 can include an odd number of pairs of snap-fit legs 664 such that one pair of snap-fit legs 664 is centrally located along upper edge 628 of lens 626. In a specific embodiment, ribs 665 extend in a direction substantially perpendicular to the direction that snap-fit legs 664 extend from the bottom surface of lip 658. In a specific embodiment, a surface of each rib 665 forms an angle with a surface of the corresponding snap-fit leg 664 of between 85 degrees and 95 degrees.

Ribs 665 engage a surface of lens 626 to securely attach lip 658 to lens 626 and sandwich a portion of shell 660 between lip 658 and lens 626. In a specific embodiment, ribs 665 of each of snap-fit legs 664 engage with the interior surface of lens 626. Ribs 665 of snap-fit legs 664 are configured to restrict removal of the snap-fit legs 664 from lens apertures 629 and shell apertures 661 by catching on the interior surface of lens 626.

Face shield assembly 610 includes a hinge 624 that is coupled to hard hat 12 and to lens 626. Hinge 624 is substantially similar to hinge 524, except for the differences discussed herein. Shell 660 of gasket 630 extends along upper edge 628 of lens 626 from one end of hinge 624 to an opposing end of hinge 624. Hinge 624 actuates lens 626 between a lowered operating position and a raised stowed position. At least a portion of lens 626 is below brim 22 of hard hat 12 when lens 626 is in the lowered operating position, and at least a portion of lens 626 is above brim 22 when lens 626 is in the raised stowed position. When in the lowered operating position, the interior surface of lens 626 is configured to face toward the head of a wearer of hard hat 12, and an exterior surface of lens 626 is configured to face away from the head of a wearer of hard hat 12.

When lens 626 is actuated between the lowered operating position and the raised stowed position, upper edge 628 of lens 626 is spaces away from external surface 16 of hard hat 12 such that a gap is formed between upper edge 628 and external surface 16. Gasket 630 is configured such that, when lens 626 is actuated between the lowered operating position and the raised stowed position, shell 660 extends across the gap between upper edge 628 of lens 626 and external surface 16 of hard hat 12 such that gasket 630 seals the gap between upper edge 628 and external surface 16. In a specific embodiment, gasket 630 seals the gap between upper edge 628 and external surface 16 with respect to particulate matter but does not seal the gap with respect to gases.

In this embodiment, shell 660 is formed from a flexible material, such as rubber or other soft polymer material. Shell 660 is formed from a material that is more flexible than the material that hard hat 12 is formed from such that gasket 630 is a flexible gasket and hard hat 12 is formed from a rigid material. Shell 660 is formed from a material having a durometer and/or modulus of elasticity that is less than the durometer and/or modulus of elasticity of the material forming hard hat 12. In some embodiments, shell 660 is formed from a material having a durometer and/or modulus of elasticity that is less than the durometer and/or modulus of elasticity of the material forming lens 626.

Forming shell 660 from a flexible material allows gasket 630 to slide along and conform to the shape of the external surface 16 of hard hat 12 as lens 626 is actuated between the lowered operating position and the raised stowed position, thereby preventing or limiting dust or debris from entering the space between lens 626 and the user's face. In a specific embodiment, shell 660 maintains continuous contact with external surface 16 of hard hat 12 when lens 626 is actuated between the lowered operating position and the raised stowed position. This constant contact results in gasket 630 preventing or limiting particulate matter from passing between upper edge 628 of lens 626 and external surface 16 of hard hat 12 toward the interior surface of lens 626.

Figure 28:
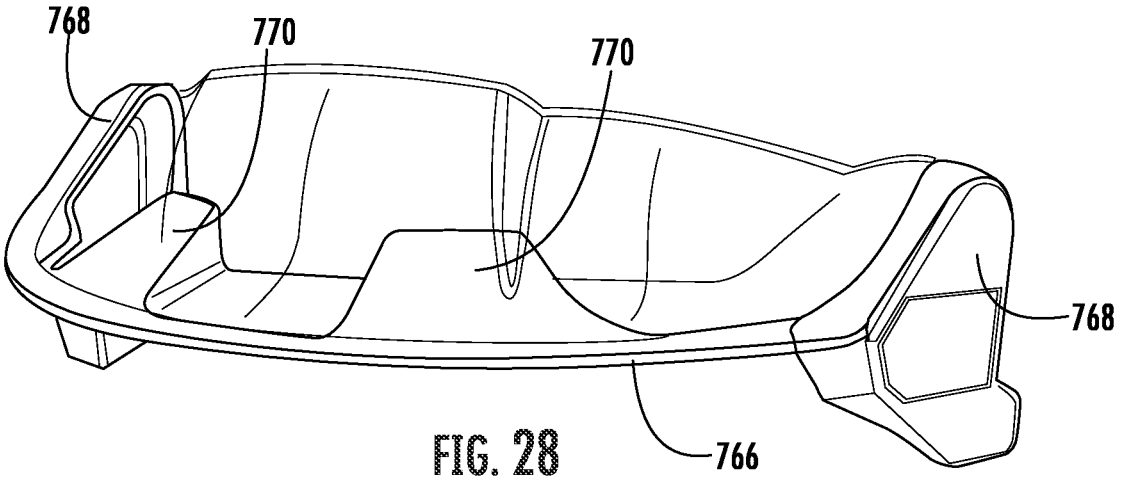
FIG. 28 is a detailed perspective view of a frame of the gasket of FIG. 27, according to an exemplary embodiment.

Referring to FIGS. 26-29, face shield assembly 710 is shown, according to an exemplary embodiment. Face shield assembly 710 is substantially similar to face shield assembly 510 except for the differences discussed herein. Face shield assembly 710 includes a hinge 724, a lens 726, and a gasket 730. Gasket 730 includes a shell 760 and a frame 766 having end caps 768. End caps 768 overlay hinge joints 721 of hinge 724. End caps 768 also include surfaces that are oriented at an angle with respect to brim 22 of hard hat 12. This structure reduces the amount of dust or debris that can accumulate near hinge joints 721. Shell 760 is over-molded onto frame 766. As shown in FIG. 28, frame 766 includes support structures 770 that engage an interior surface of shell 760. Support structures 770 are configured to buttress the structure of shell 760 and provide additional contact surface area between shell 760 and frame 766.

Figure 29:
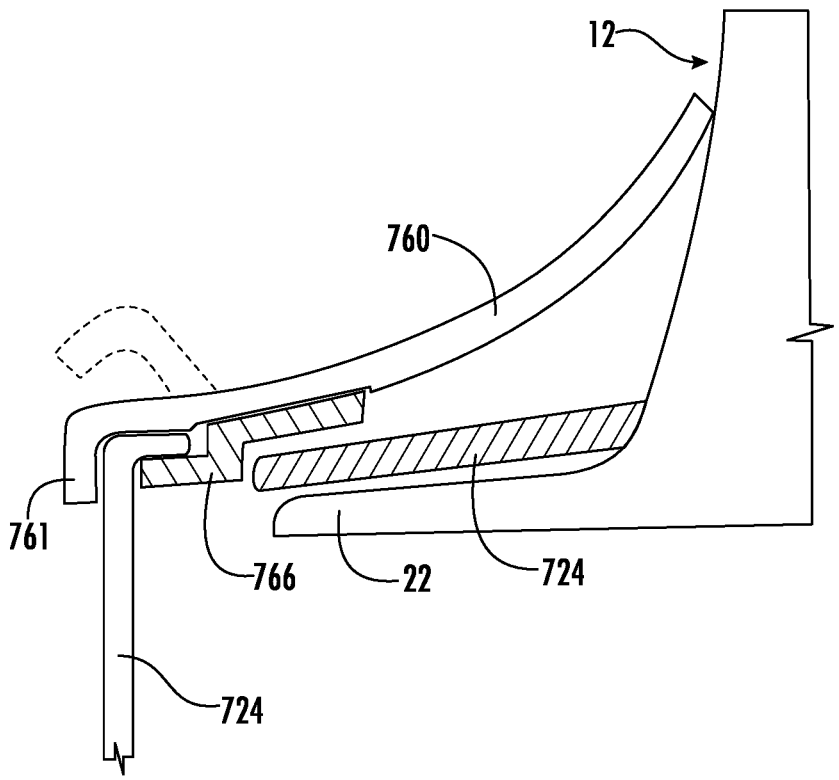
FIG. 29 is a cross-sectional view of the face shield assembly of FIG. 26, according to an exemplary embodiment.

Referring to FIG. 29, lens 726 is frictionally coupled to face shield assembly 710 between shell 760 and frame 766. In a specific embodiment, shell 760 is formed from a plastic material, rubber, or other material capable of flexing. Shell 760 biases lens 726 toward frame 766 to securely attach lens 726 to face shield assembly 710. A lower rim 761 of shell 760 can bend upward such that shell 760 no longer contacts lens 726. This structure allows users to easily remove and replace lens 726 by bending the lower rim 761 away from lens 726.

Figure 30:
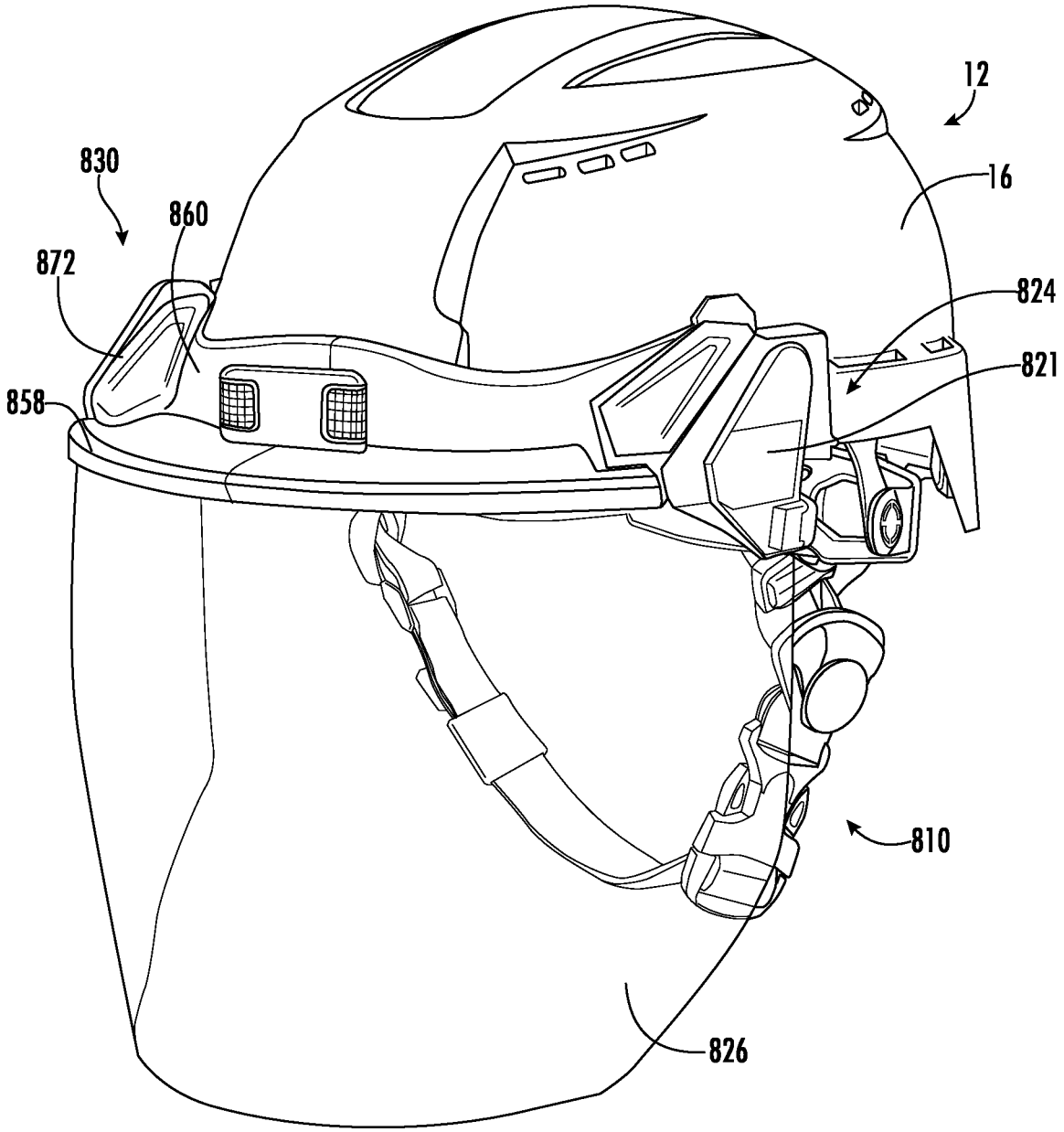
FIG. 30 is a perspective view of a hard hat with a face shield assembly including a gasket and mounting port with a face shield in a lowered operating position, according to an exemplary embodiment.
Figure 31:
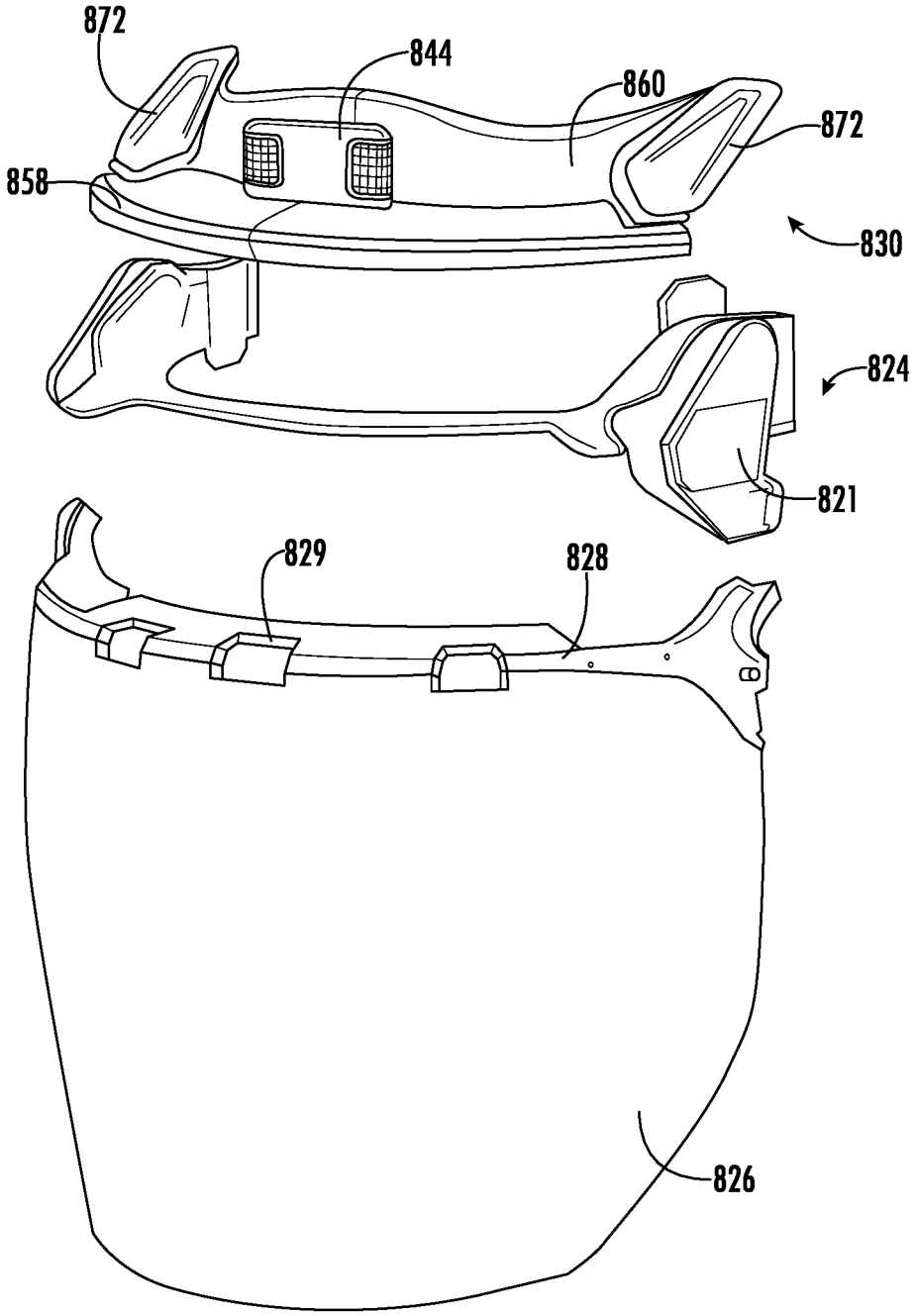
FIG. 31 is an exploded view of the face shield assembly of FIG. 30, according to an exemplary embodiment.
Figure 32:
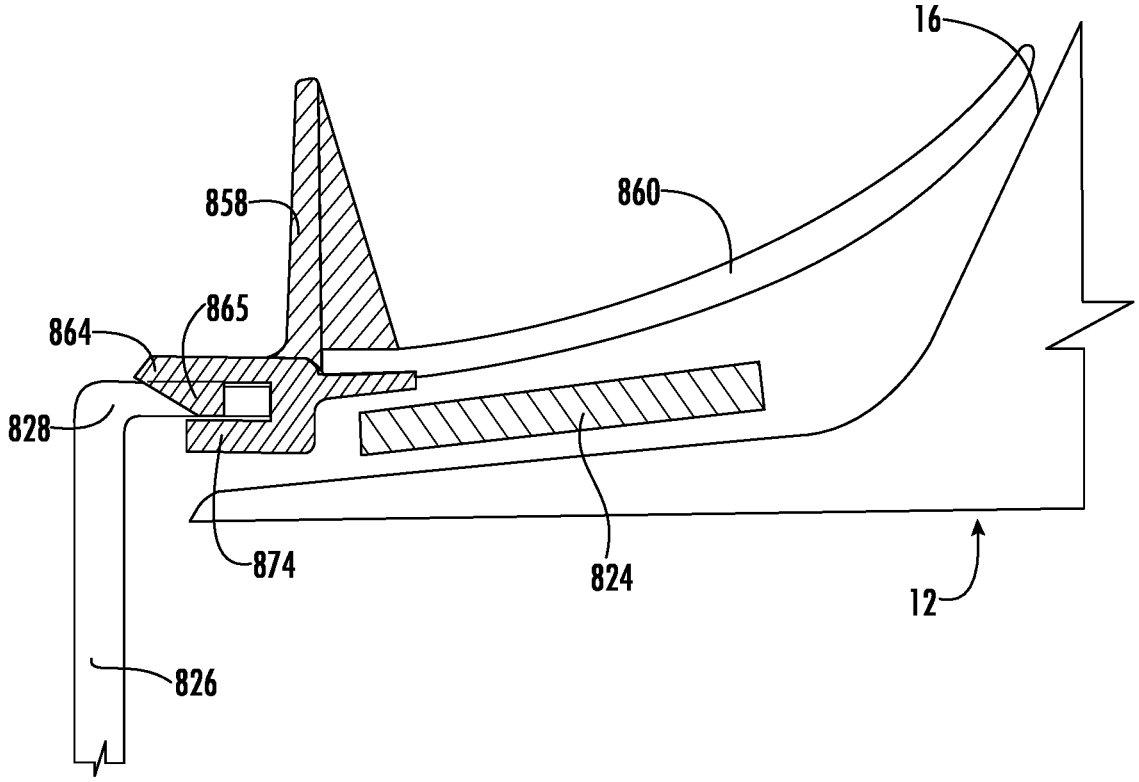
FIG. 32 is a cross-sectional view of the face shield assembly of FIG. 30, according to an exemplary embodiment.

Referring to FIGS. 30-32, face shield assembly 810 is shown, according to an exemplary embodiment. Face shield assembly 810 is substantially similar to face shield assembly 510 except for the differences discussed herein. Face shield assembly 810 includes a hinge 824, a lens 826, a mounting port 844, and a gasket 830 that includes a lip 858, a shell 860, and hinge flaps 872. Shell 860 is over-molded onto lip 858, and hinge flaps 872 are over-molded onto shell 860. In a specific embodiment, lip 858 and hinge flaps 872 are formed from plastic materials, and shell 860 is formed from a flexible material, such as rubber or a soft polymer material. Hinge flaps 872 overlay portions of hinge joints 821 of hinge 824 and provide a surface angled with respect to the external surface 16 of hard hat 12, hinge 824, and lip 858. This structure provides additional protection to hinge 824 and reduces the flat surface area of the face shield assembly 810 that could accumulate dust or debris. Mounting port 844 allows users to couple additional components to face shield assembly 810, such as a headlamp.

Referring to FIG. 32, lip 858 includes a lower ridge 874 that extends from the lip 858 in the direction of lens 826. Lip 858 also includes snap-fit legs 864 located above lower ridge 874 that extend from lip 858 in substantially the same direction as lower ridge 874. The ribs 865 of snap-fit legs 864 extend toward lower ridge 874. Lens 826 includes a plurality of apertures 829 along an upper edge 828 of lens 826 configured to receive ribs 865 such that lens 826 is coupled to lip 858 between lower ridge 874 and snap-fit legs 864.

In another embodiment, the face shield assembly is a bump face shield including a bump lens and a debris tray. The bump lens and debris tray are pivotally attached to a brim of a hard hat along a pivot axis. The debris tray is coupled to the bump lens at an upper edge of the bump lens such that rotation of the bump lens about the pivot axis causes the debris tray to rotate about the pivot axis. The debris tray covers at least a portion of the brim of the hard hat when the bump lens is in a lowered operating position. This structure allows users to bump or tilt the lower end of the bump lens toward the user's face or chest and rotate the debris tray such that dust or debris that has accumulated on the dust tray is expelled forward and away from the user. The debris tray includes a rear wall configured to stop dust or debris from falling toward the hard hat when the bump lens is rotated. The face shield assembly can include a biasing element, such as a spring, that rotationally biases the debris tray toward the brim of the hard hat in order to stabilize the bump lens when not expelling dust or debris.

Referring to FIGS. 33-43, face shield assembly 910 including a face shield frame 976 and a brim mount 982 that form a hinge 924 is shown, according to an exemplary embodiment. Face shield assembly 910 is substantially similar to face shield assembly 610 except for the differences discussed herein. Embodiments of hinge 924 discussed herein include an innovative interlocking pivot design to provide for a variety of desired characteristics, including secure attachment of a face shield frame to a brim requiring few components. Further, Applicant has found that reducing the number of components making up hinge 924 reduces the costs of manufacture and the costs of assembly with respect to conventional face shield pivot systems.

Figure 33:
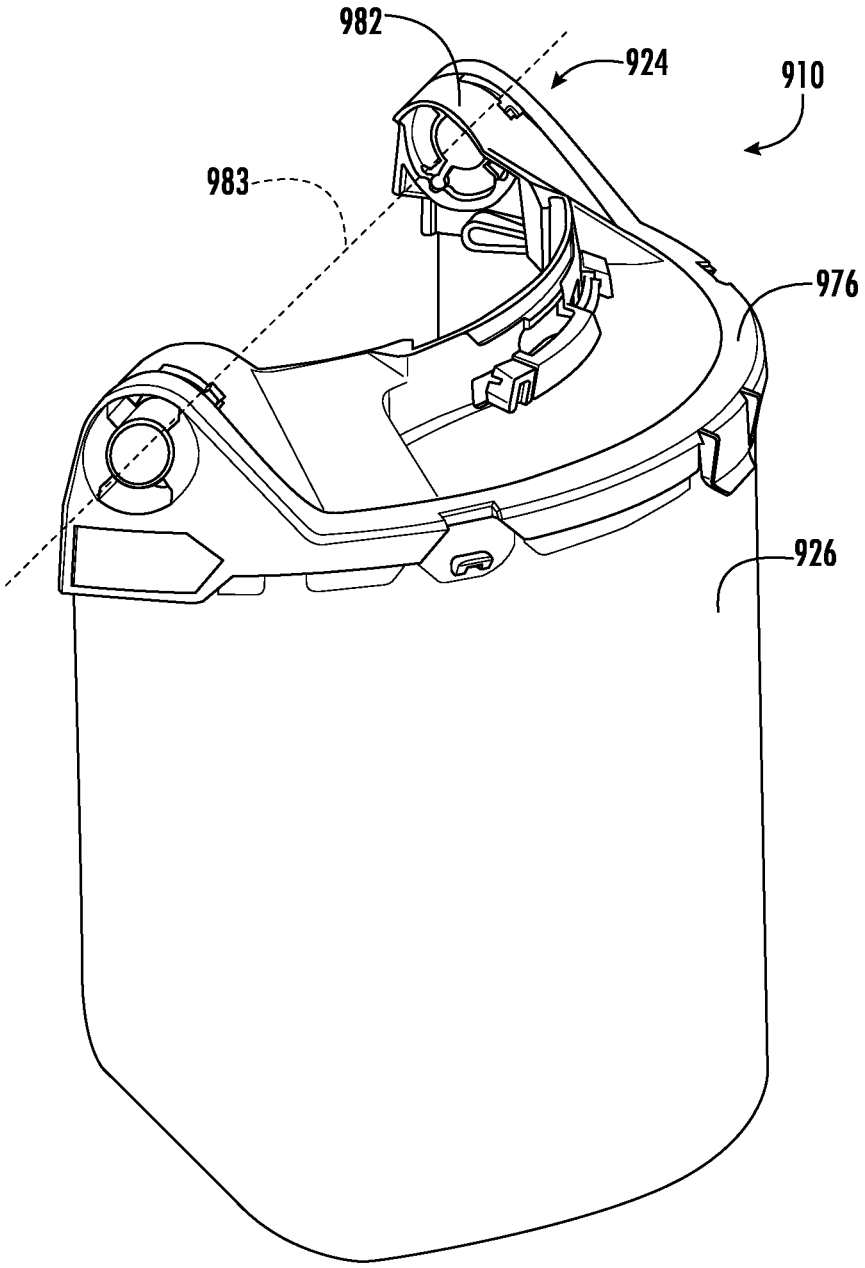
FIG. 33 is a perspective view of a face shield assembly including a face shield frame and brim mount hinge, according to an exemplary embodiment.

Referring to FIG. 33, face shield assembly 910 includes a lens 926. Lens 926 couples to face shield frame 976. In a specific embodiment, lens 926, face shield frame 976, and/or brim mount 982 have curved or arcuate shapes. Lens 926 includes an interior surface and an exterior surface, the interior surface being positioned radially inward relative to the exterior surface with respect to the arcuate shape of lens 926. Face shield frame 976 couples to brim mount 982 to form hinge 924 having a pivot axis 983 that defines a pivot axial direction. Brim mount 982 is configured to couple face shield assembly 910 to a hard hat. In a specific embodiment, face shield assembly 910 is coupled to hard hat 12.

When attached to a hard hat, hinge 924 allows a user of the hard hat to actuate face shield assembly 910 between a lowered operating position in which lens 926 is in front of the user's face and a raised stowed position in which lens 926 is away from and/or above the user's face. When in the lowered operating position, the interior surface of lens 926 faces toward the head of the user, the exterior surface of lens 926 faces away from the head of the user, and at least a portion of lens 926 is positioned below a brim of the hard hat. When in the raised stowed position, at least a portion of lens 926 is positioned above the brim of the hard hat.

Figure 34:
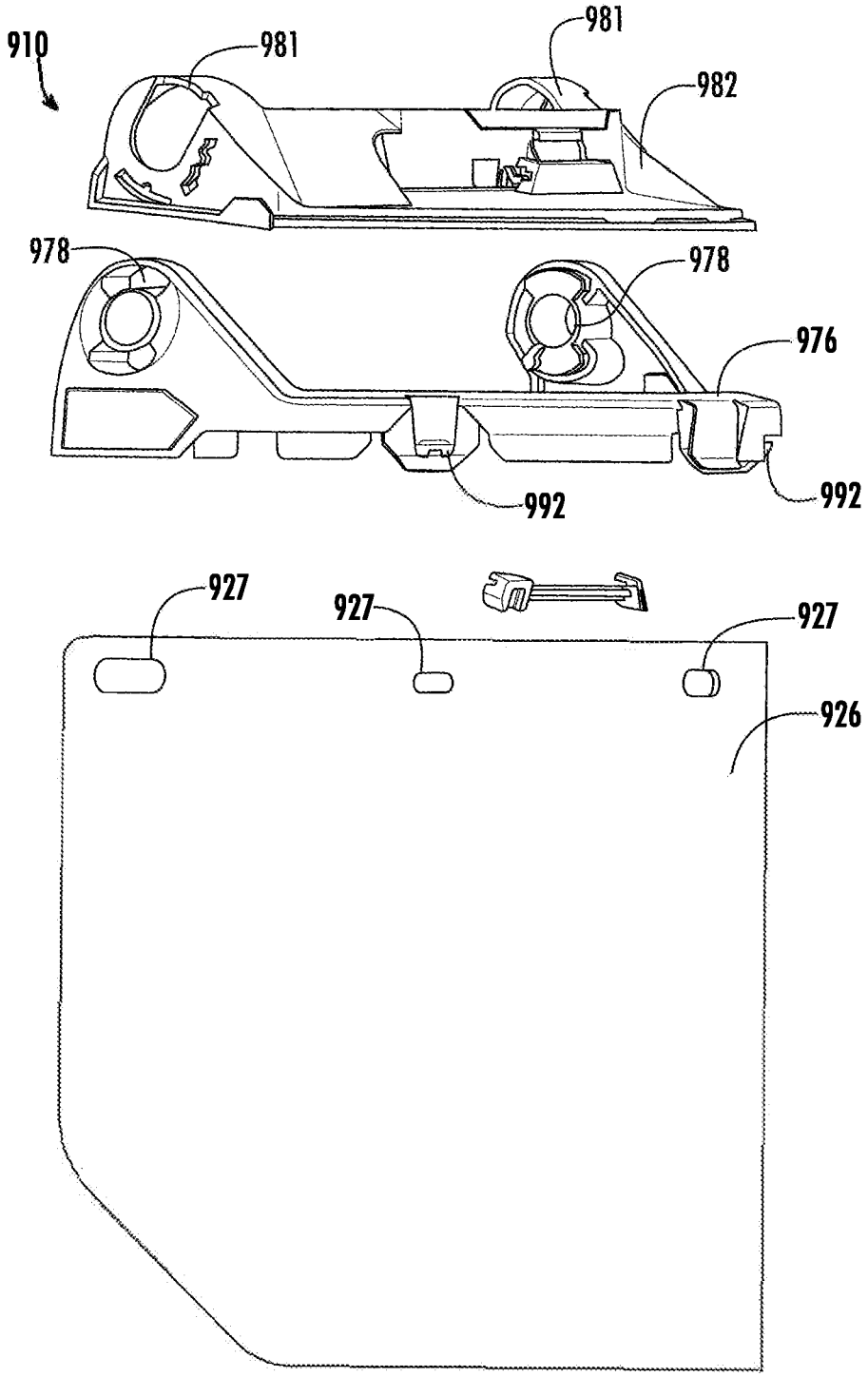
FIG. 34 is an exploded view of the face shield assembly of FIG. 33, according to an exemplary embodiment.
Figure 35:
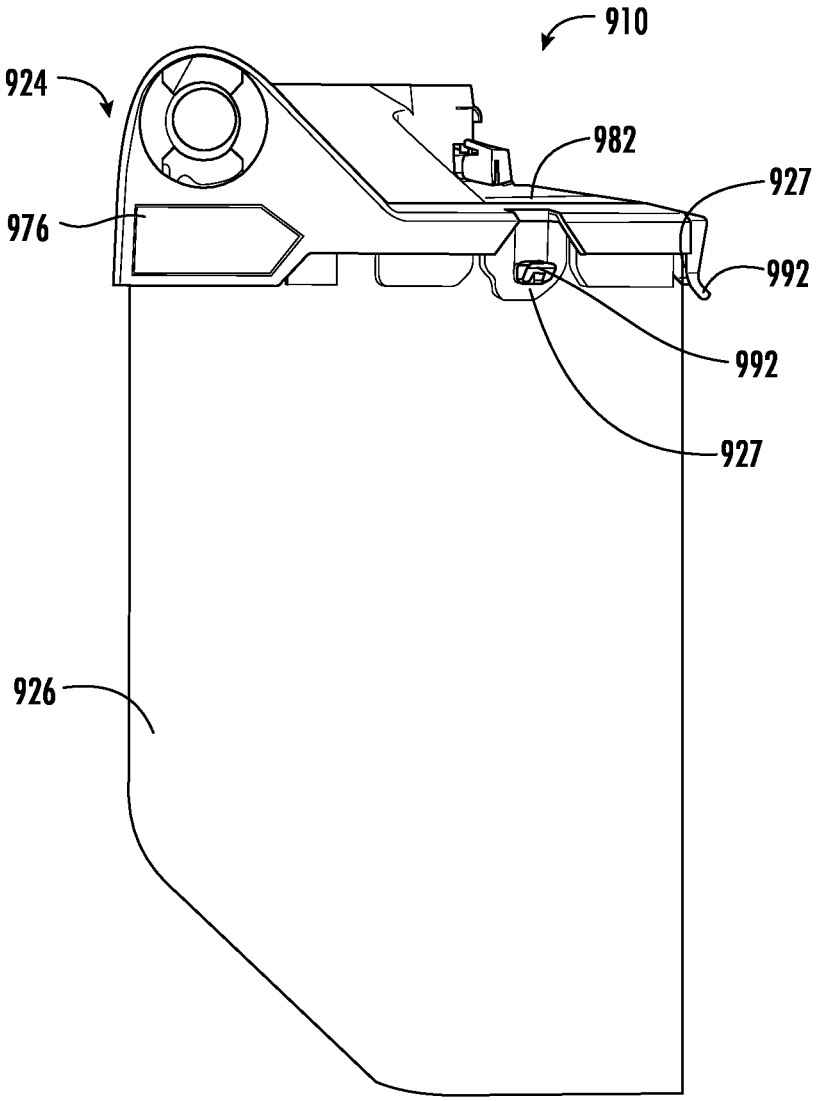
FIG. 35 is a side view of the face shield assembly of FIG. 33, according to an exemplary embodiment.

As shown in FIG. 34, lens 926 includes a plurality of holes 927 adjacent to an upper edge of lens 926. Face shield frame 976 includes a plurality of tabs 992 protruding radially outward with respect to an exterior curved surface of face shield frame 976. Referring to FIG. 35, tabs 992 of face shield frame 976 pass through holes 927 of lens 926 to couple face shield frame 976 to lens 926.

Figure 36:
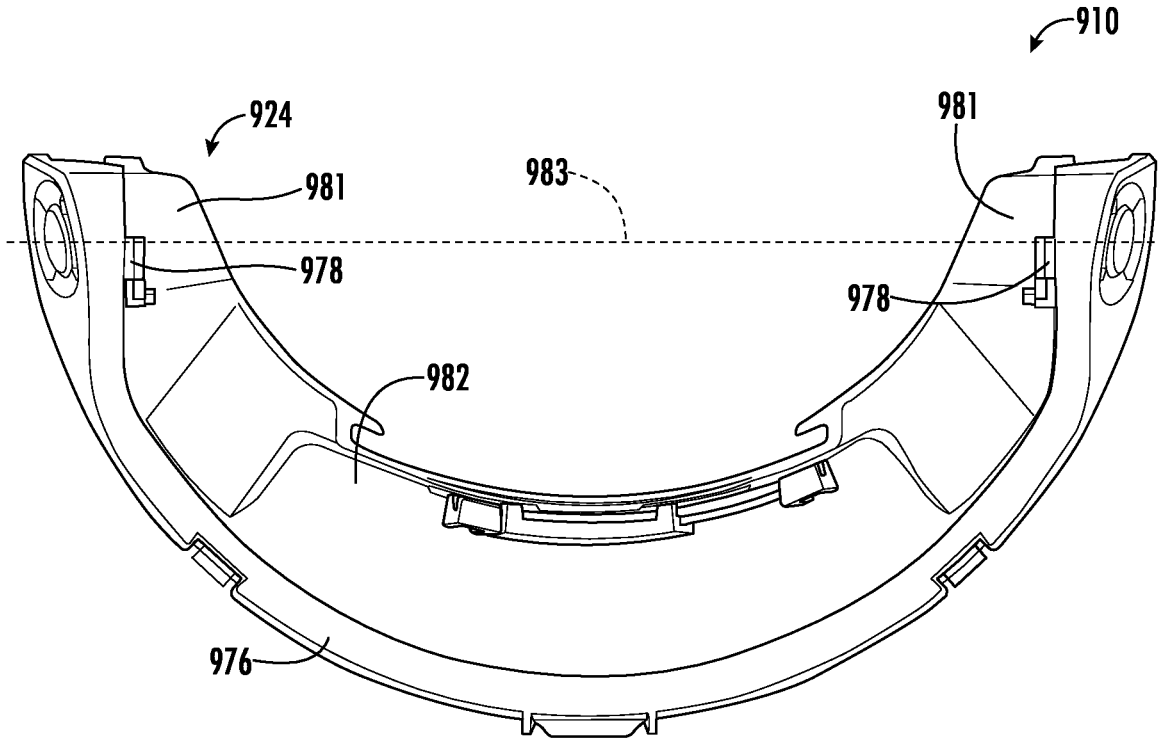
FIG. 36 is a top view of the face shield assembly of FIG. 33, according to an exemplary embodiment.

As shown in FIG. 36, face shield frame 976 includes a pivot projection 978 extending radially inward from a concave curved interior surface of face shield frame 976. In a specific embodiment, face shield frame 976 includes two pivot projections 978 on opposing ends of face shield frame 976 such that pivot projections 978 extend toward each other. In some embodiments, pivot projections 978 are integrally formed with face shield frame 976 such that face shield frame 976 and pivot projections 978 are a single continuous, contiguous piece. Brim mount 982 includes a pivot receiver 981. In a specific embodiment, brim mount 982 includes two pivot receivers 981 on opposing ends of brim mount 982 such that pivot axis 983 aligns with the center of each pivot receiver 981. In some embodiments, pivot receivers 981 are integrally formed with brim mount 982 such that brim mount 982 and pivot receivers 981 are a single continuous, contiguous piece. Brim mount 982 is configured such that a curved concave interior surface of brim mount 982 conforms to a curved crown segment or brim of a hard hat.

Figure 37:
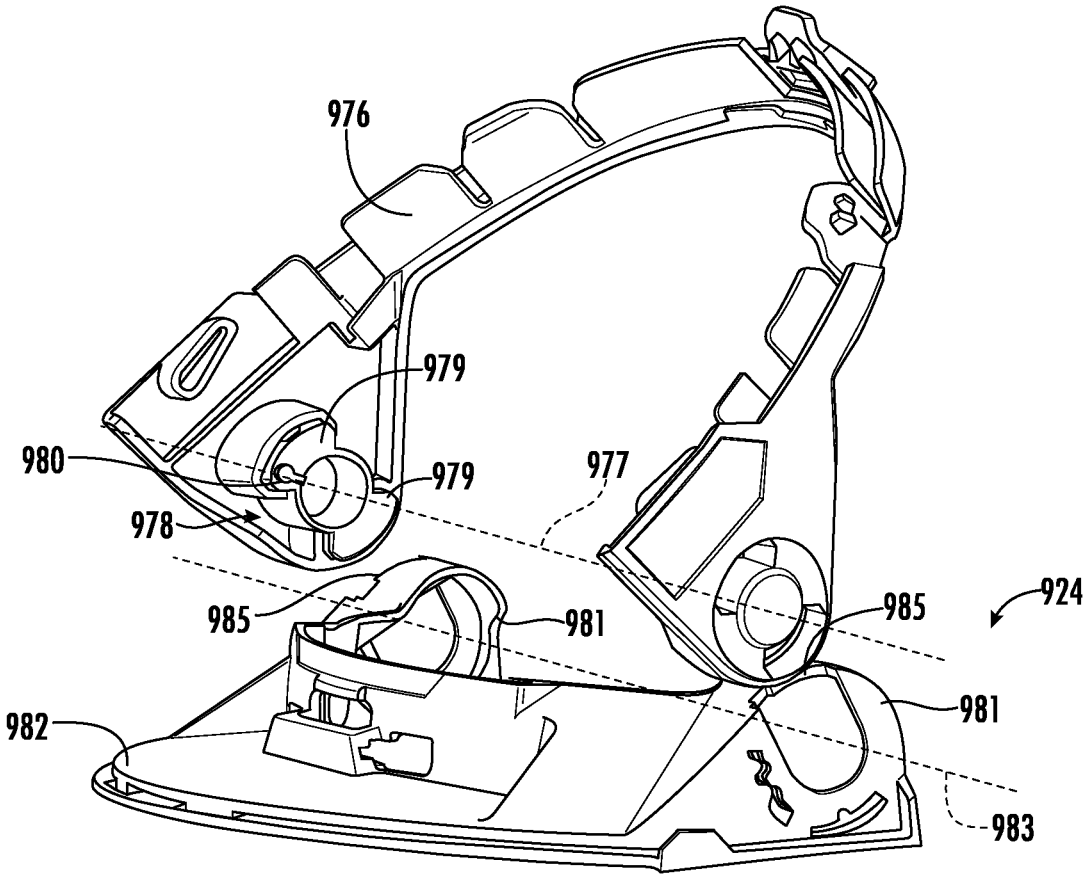
FIG. 37 is a right-side perspective view of a brim mount and a face shield frame of the face shield assembly of FIG. 33 with the face shield frame in a rotated and detached position, according to an exemplary embodiment.
Figure 38:
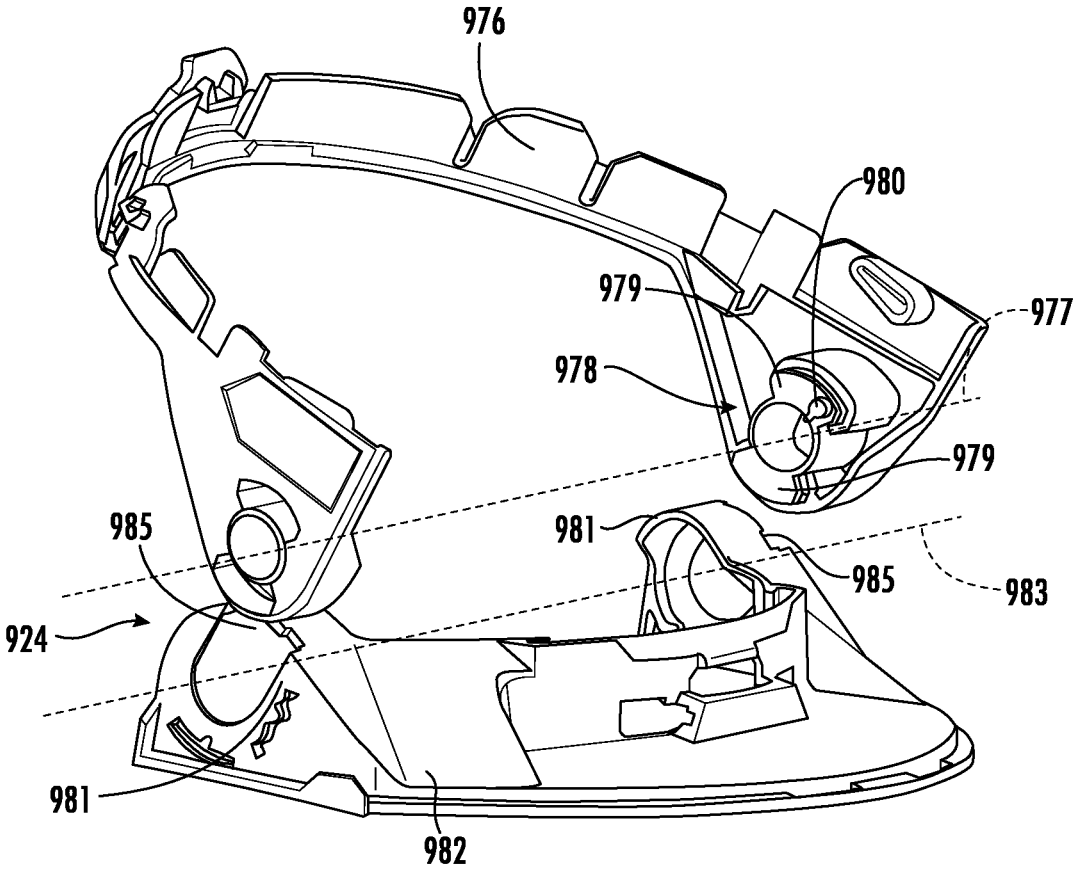
FIG. 38 is a left-side perspective view of a brim mount and a face shield frame of the face shield assembly of FIG. 33 with the face shield frame in a rotated and detached position, according to an exemplary embodiment.

Referring to FIG. 37, face shield frame 976 includes a frame axis 977 that aligns with the center of each pivot projection 978. Pivot projections 978 of face shield frame 976 include a pivot wing 979 extending radially away from frame axis 977. In a specific embodiment, face shield frame 976 includes a plurality of pivot wings 979 on each of the opposing pivot projections 978, as shown in FIGS. 37 and 38. Pivot receivers 981 of brim mount 982 include slot openings 985. Prior to assembling hinge 924, face shield frame 976 is rotated with respect to brim mount 982 such that pivot wings 979 of face shield frame 976 align with slot openings 985 of brim mount 982. Pivot projections 978 are inserted into slot openings 985 to pivotally couple face shield frame 976 to brim mount 982. Face shield frame 976 can then be rotated about pivot axis 983 such that a top surface of face shield frame 976 and a top surface of brim mount 982 are generally flush, thereby adjusting face shield assembly 910 and lens 926 into the lowered operating position shown in FIGS. 33-36.

Figure 39:
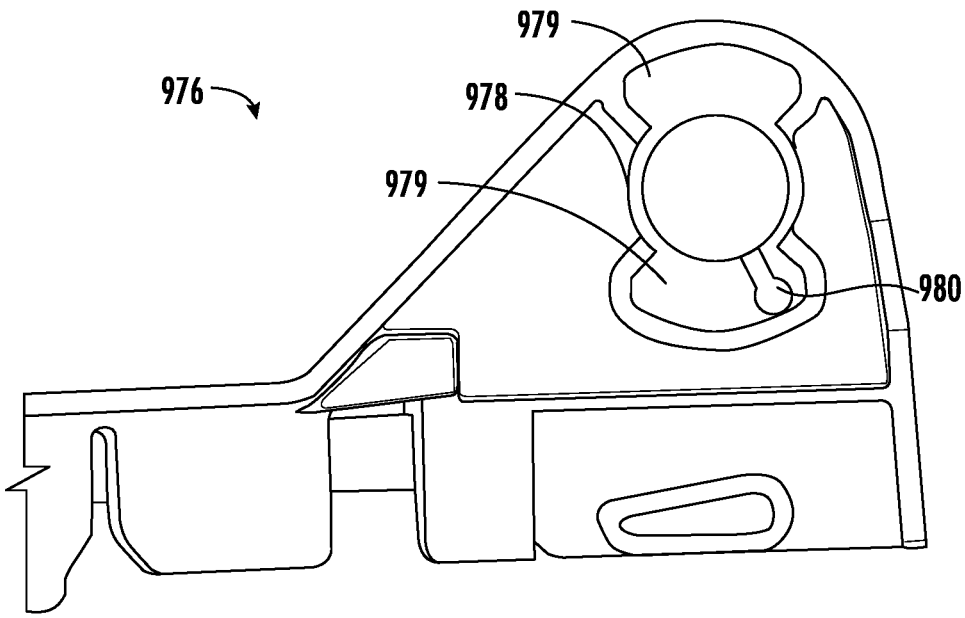
FIG. 39 is a detailed side view of the face shield frame of the face shield assembly of FIG. 33, according to an exemplary embodiment.

Referring to FIG. 39, at least one of pivot wings 979 includes a locking protrusion 980 extending away from pivot wings 979. In a specific embodiment, locking protrusion 980 extends radially inwardly with respect to the concave curved interior surface of face shield frame 976 and in a direction generally parallel to frame axis 977, shown in FIGS. 37 and 38. An outward facing surface of pivot wing 979 with respect to a center of face shield frame 976 and a direction along frame axis 977 is spaced apart from an inner surface of face shield frame 976 along frame axis 977 such that there is a gap between pivot wing 979 and an inner surface of face shield frame 976.

Figure 40:
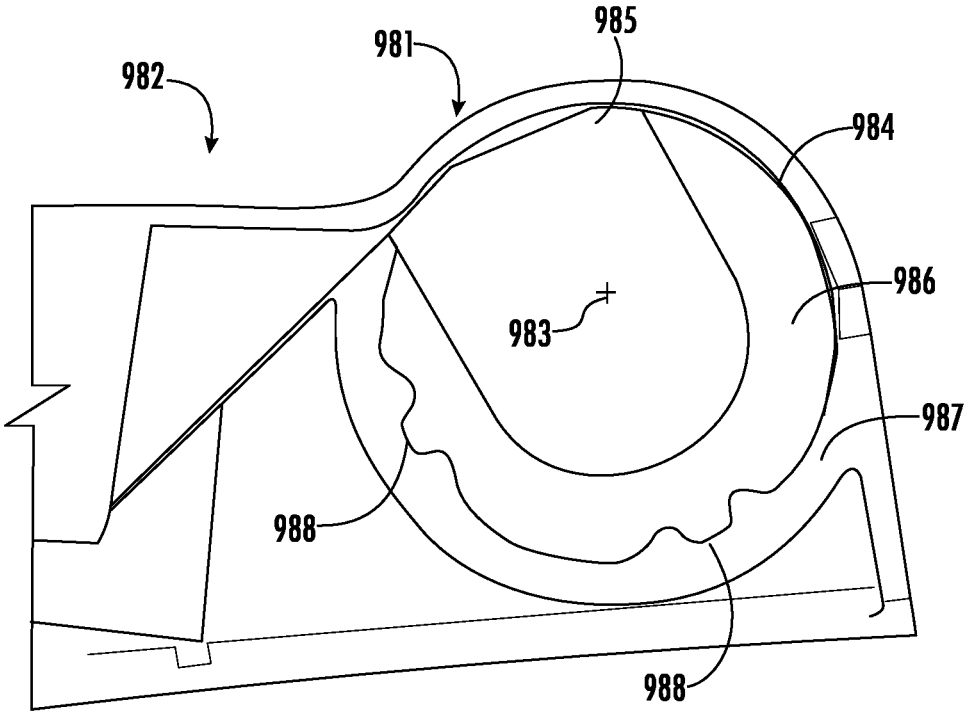
FIG. 40 is a detailed side view of the brim mount of the face shield assembly of FIG. 33, according to an exemplary embodiment.

Referring to FIG. 40, pivot receiver 981 includes a pivot slot 984 formed by slot opening 985, an outer retaining wall 986 and an inner retaining wall 987. Outer retaining wall 986 is spaced radially outwardly apart from inner retaining wall 987 with respect to a concave curved interior surface of brim mount 982 such that there is a gap between outer retaining wall 986 and inner retaining wall 987. Inner retaining wall 987 includes a plurality of detents 988 formed by radially inward extending protrusions on either side of detents 988. In an alternative embodiment, pivot receivers 981 are located on face shield frame 976 and pivot projections 978 are located on brim mount 982.

Figure 41:
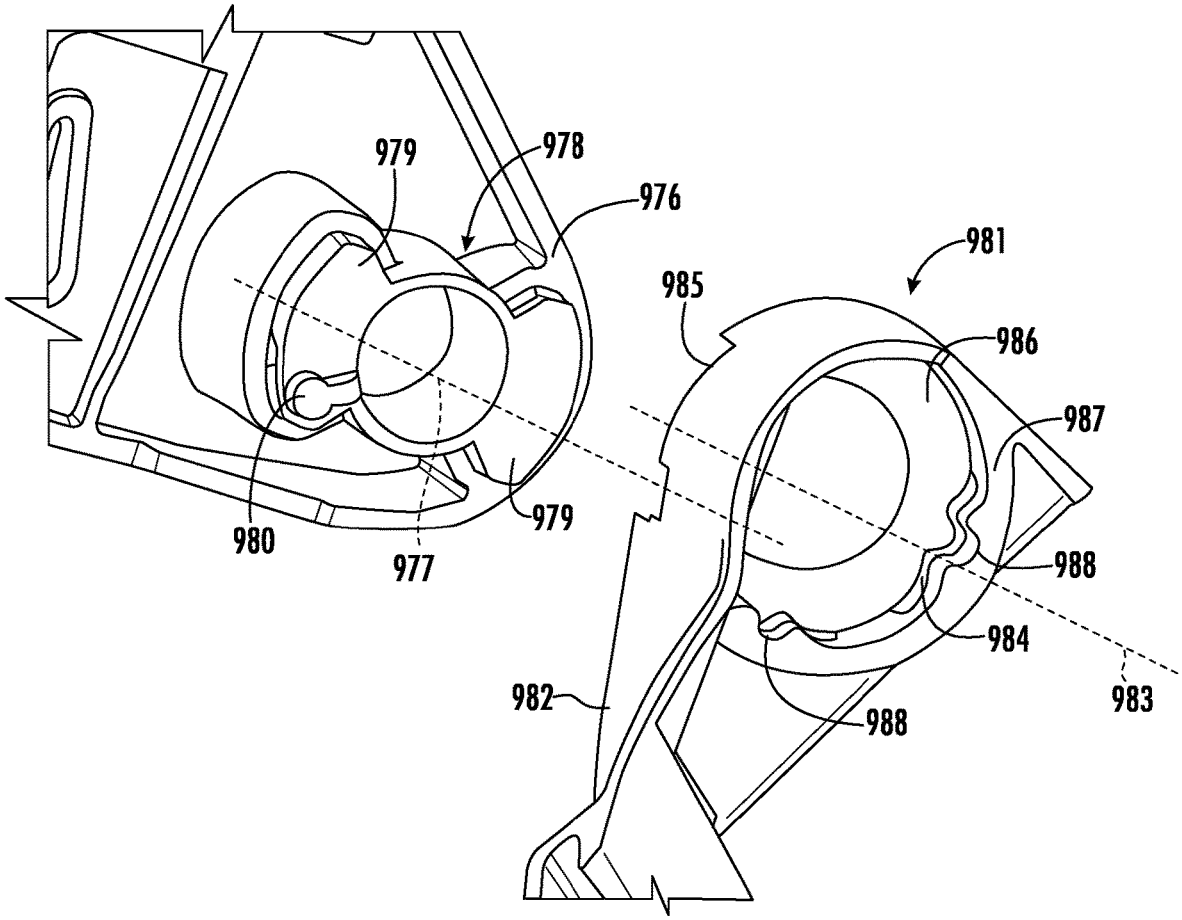
FIG. 41 is a detailed perspective view of the brim mount and face shield frame of the face shield assembly of FIG. 33 with the face shield frame in a rotated and detached position, according to an exemplary embodiment.
Figure 42:
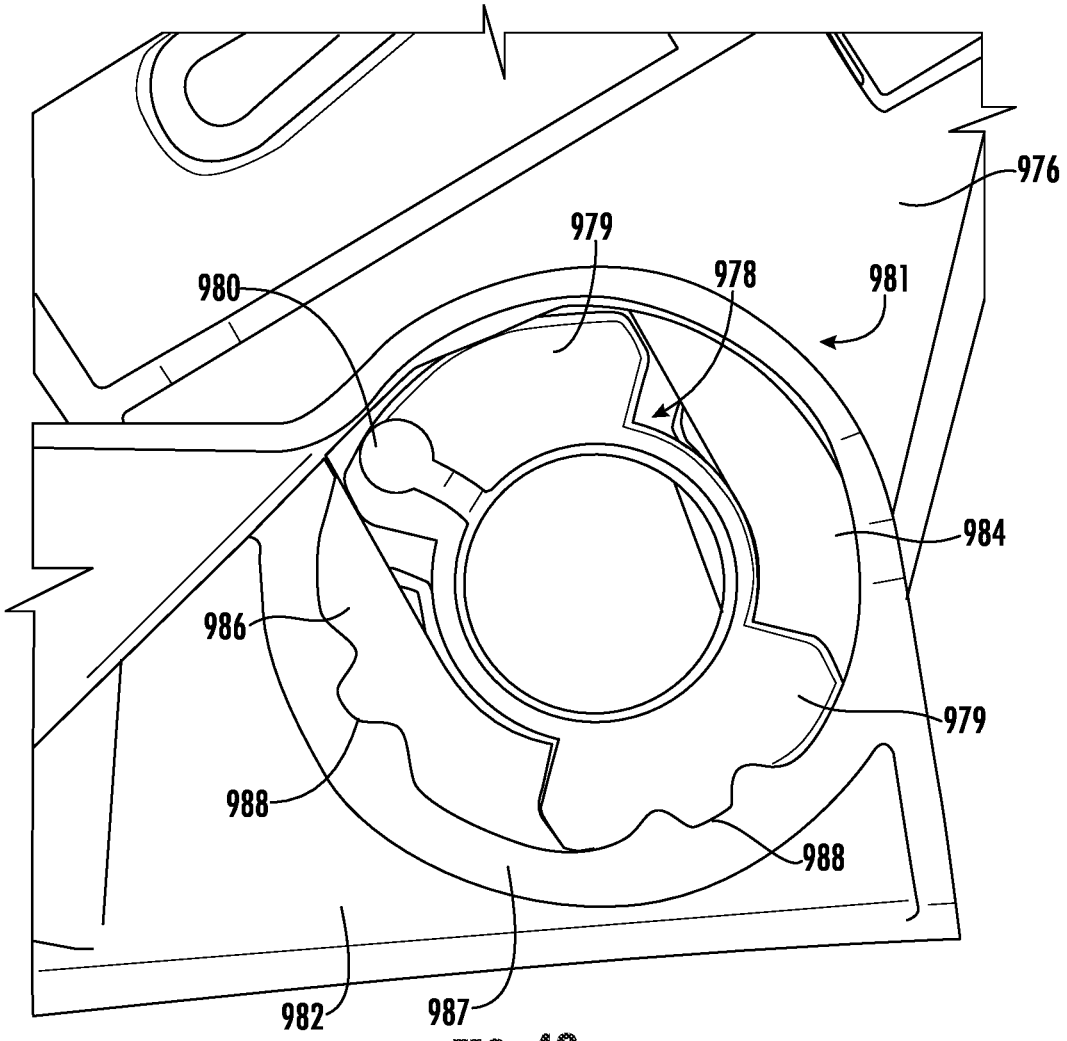
FIG. 42 is a detailed side view of the brim mount and face shield frame of the face shield assembly of FIG. 33 with the face shield frame in a rotated position, according to an exemplary embodiment.
Figure 43:
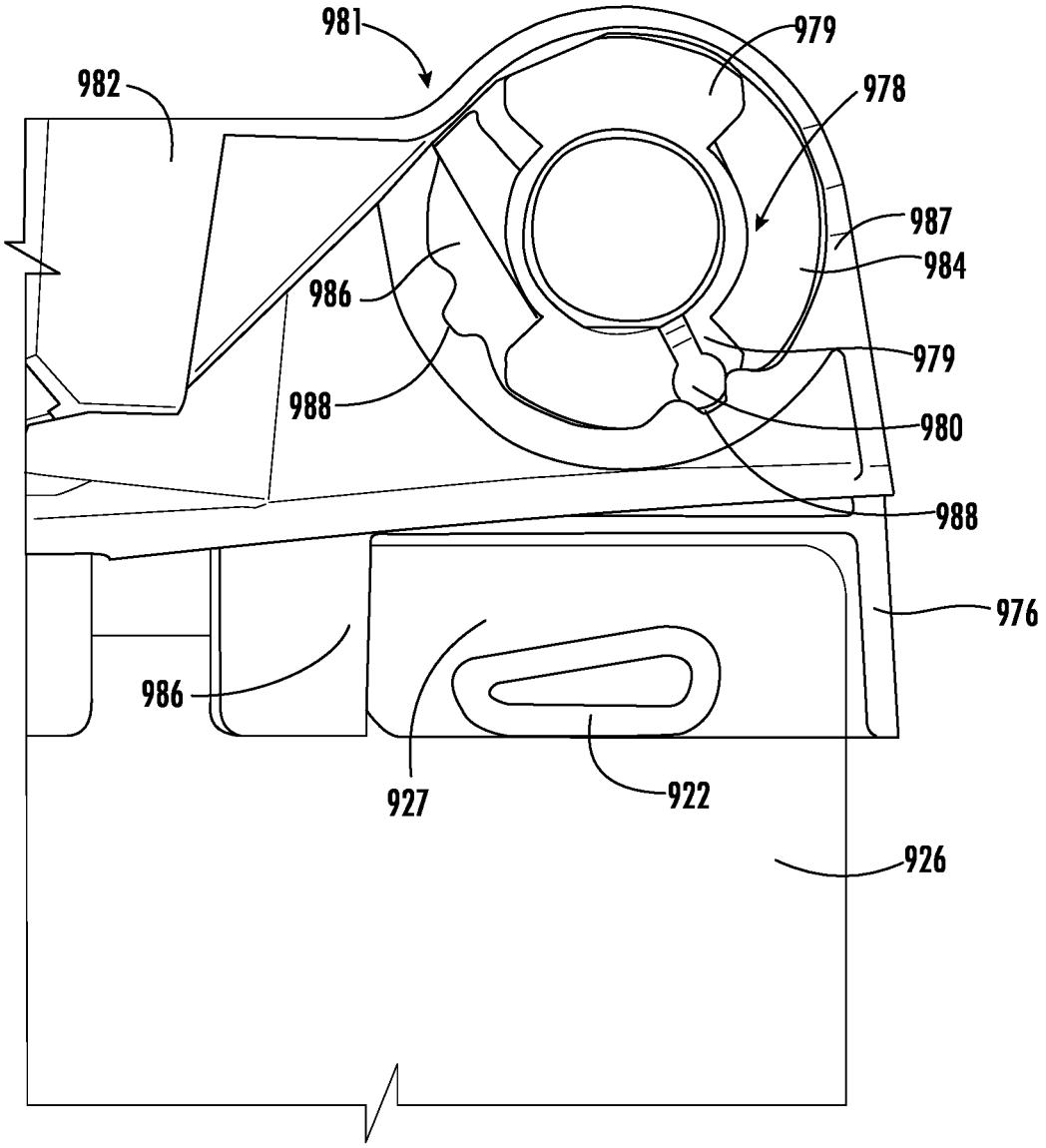
FIG. 43 is a detailed side view of the brim mount and face shield frame of the face shield assembly of FIG. 33 with the frame in an attached, according to an exemplary embodiment.

Referring to FIGS. 41-43, various stages of a method for assembling hinge 924 are shown. To assemble hinge 924, face shield frame 976 is first rotated with respect to brim mount 982 such that pivot wings 979 align with slot openings 985 such that pivot wings 979 are positioned between outer retaining wall 986 and inner retaining wall 987 with respect to the axial direction of pivot axis 983. As shown in FIG. 41, when face shield frame 976 is initially rotated to align pivot wings 979 with slot openings 985, frame axis 977 and pivot axis 983 are displaced from each other.

Referring to FIG. 42, face shield frame 976 is moved toward brim mount 982 such that pivot projection 978 passes through slot opening 985. When pivot projection 978 is inserted into pivot receiver 981, frame axis 977 and pivot axis 983 are aligned and coaxial. Pivot wings 979 are retained within pivot slot 984 and positioned in the gap between inner retaining wall 987 and outer retaining wall 986. Outer retaining wall 986 is positioned in the gap between pivot wings 979 and an inner surface of face shield frame 976.

As shown in FIG. 43, when pivot projection 978 is inserted into pivot receiver 981, face shield frame 976 can rotate with respect to brim mount 982 about pivot axis 983. As such, face shield frame 976 is rotatably coupled to brim mount 982, and hinge 924 is assembled.

When face shield frame 976 is rotated downward such that a top surface of face shield frame 976 and a top surface of brim mount 982 are generally flush, locking protrusion 980 is releasably retained within one of detents 988 such that face shield assembly 910 and lens 926 are secured in the lowered operating position. Face shield frame 976 can be rotated upward from the lowered operating position into the raised stowed position in which locking protrusion 980 is releasably retained in another of detents 988, thereby securing face shield assembly 910 and lens 926 in the raised stowed position. Detents 988 are configured such that, when locking protrusion 980 is releasably retained in one of detents 988, face shield frame 976 resists rotation about pivot axis 983 toward any other of detents 988 until sufficient force is applied, thereby providing end points for the range of motion of face shield frame 976, when face shield assembly 910 is assembled.

Brim mount 982 may then be attached to a hard hat, such as hard hat 12. Face shield assembly 910 is configured such that, when brim mount 982 is attached to a hard hat, a crown or shell of the hard hat would block or restrict face shield frame 976 from fully rotating back to the position in which the pivot wings 979 are aligned with the slot opening 985 and face shield frame 976 can be removed from brim mount 982. The shell of the hard hat restricts pivot projection 978 from rotating into a position in which pivot wings 979 are aligned with slot opening 985. As such, face shield assembly 910 is configured such that the method of assembling hinge 942 cannot be reversed to disassemble hinge 942 while brim mount 982 is attached to an appropriate hard hat.

Figure 44:
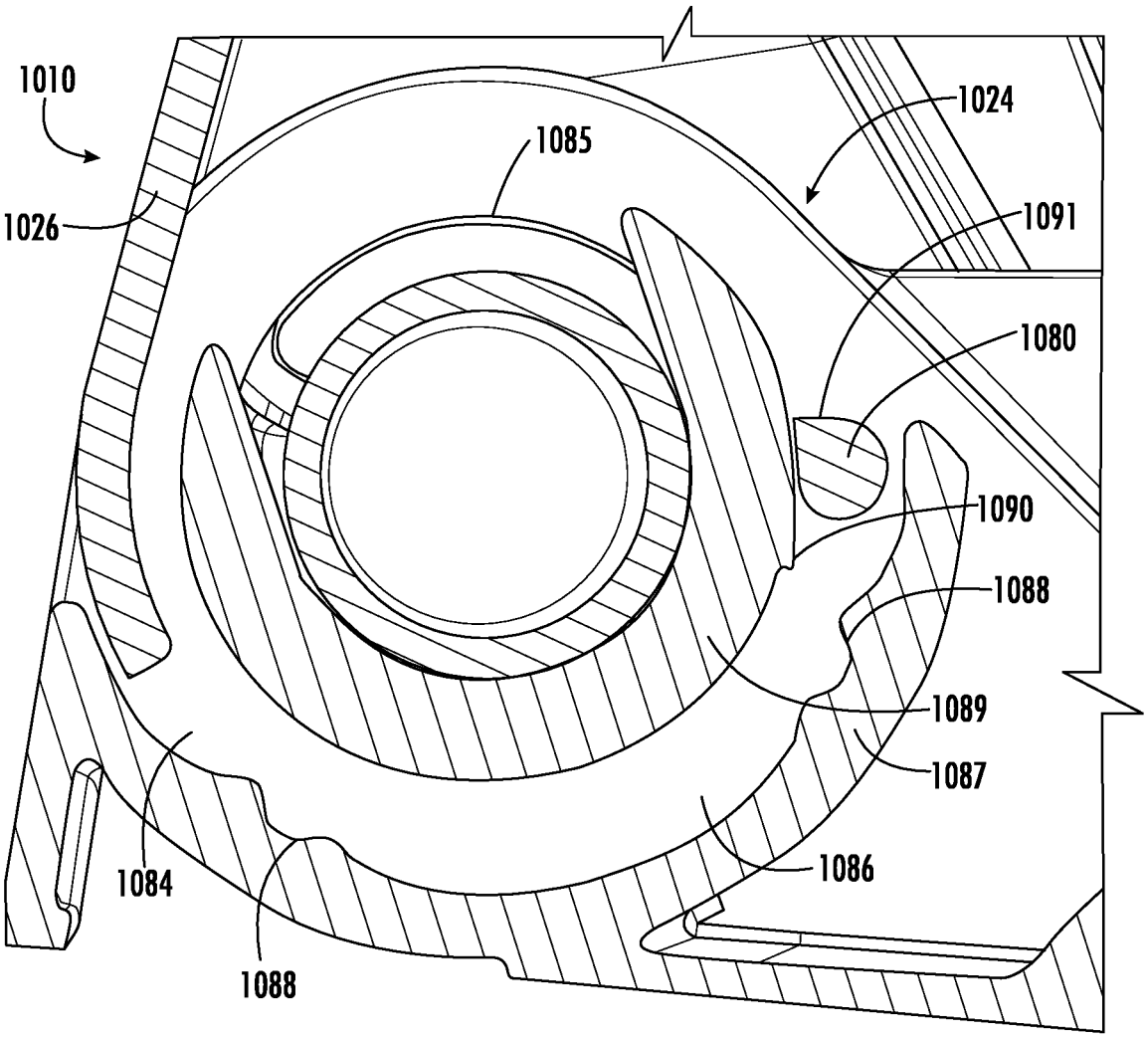
FIG. 44 is a detailed side view of a face shield assembly including a face shield frame and brim mount hinge in which the hinge is in a pre-assembled position, according to an exemplary embodiment.
Figure 45:
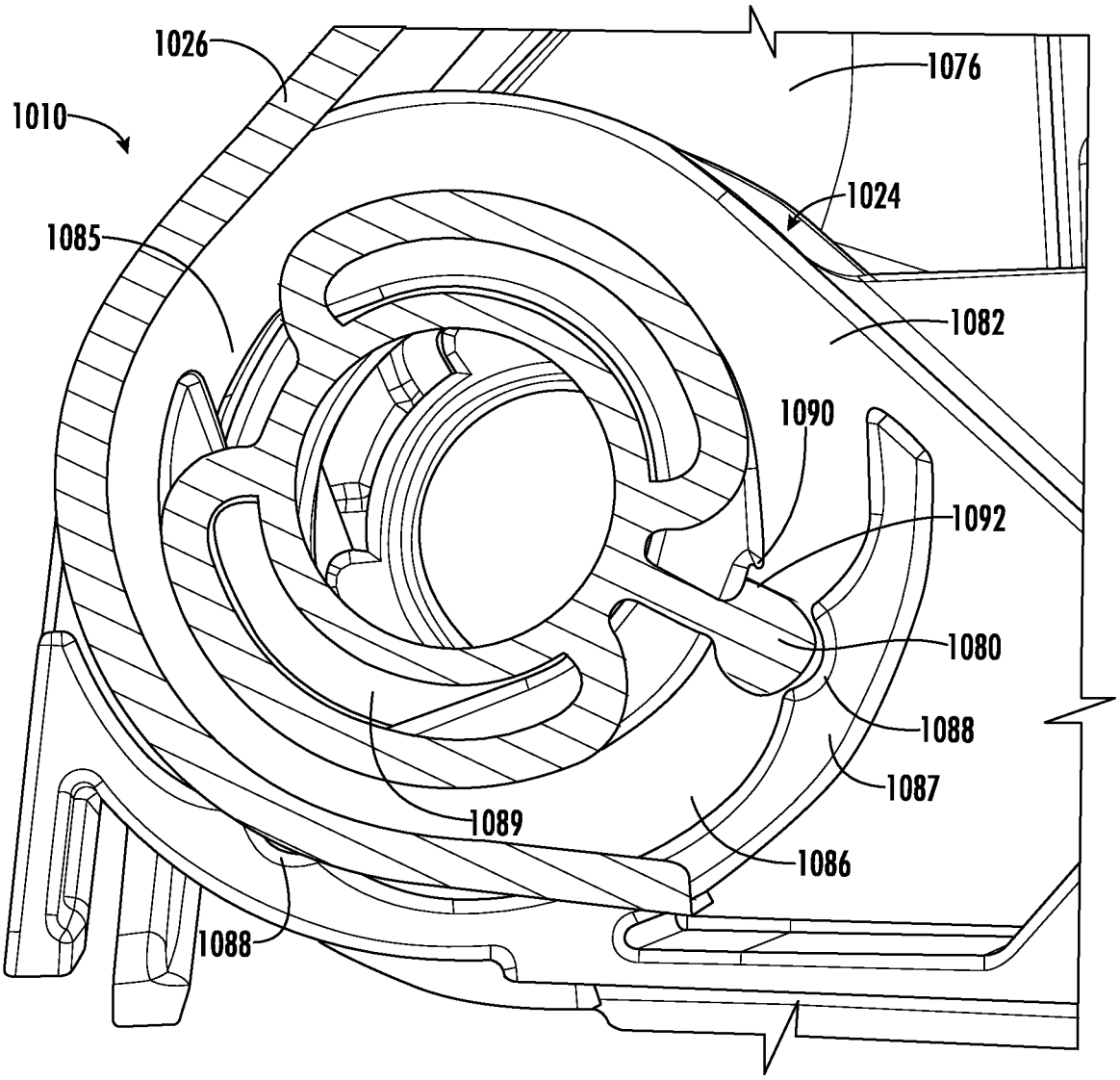
FIG. 45 is a detailed side view of the face shield assembly of FIG. 44 with the hinge in an assembled and raised stowed position, according to an exemplary embodiment.
Figure 46:
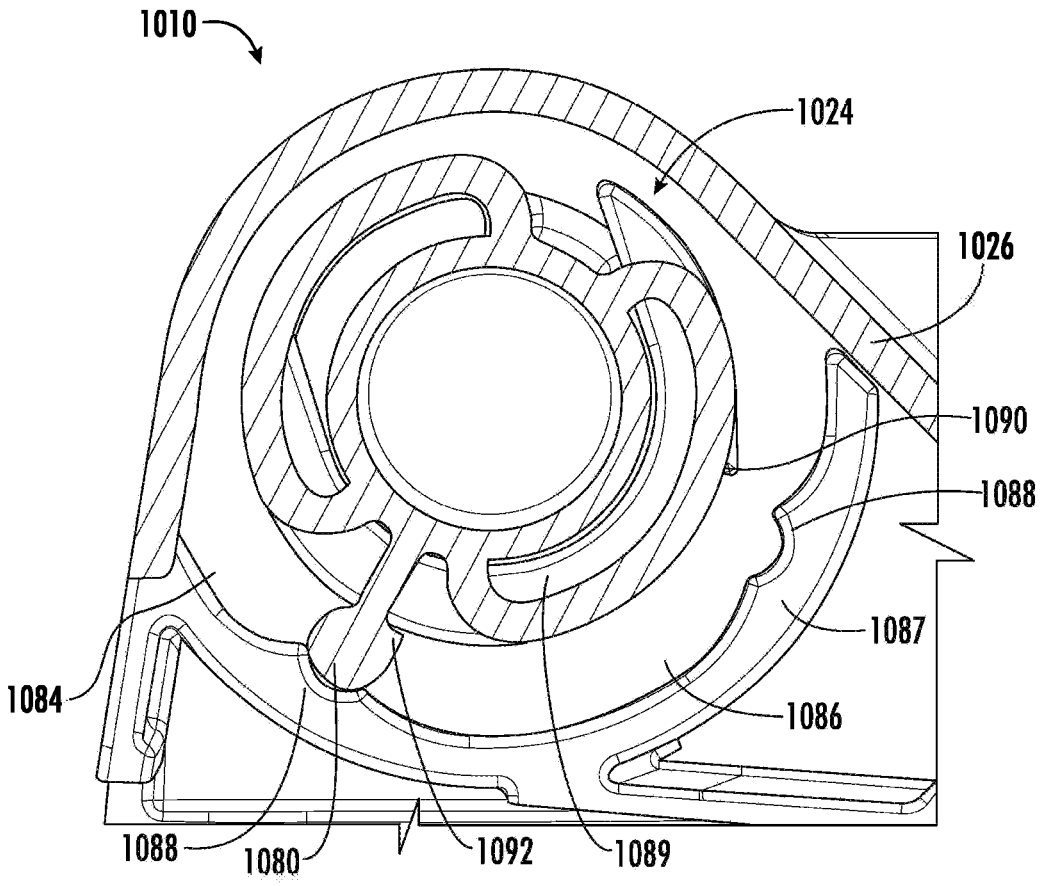
FIG. 46 is a detailed side view of the face shield assembly of FIG. 44 with the hinge in an assembled and lowered operating position, according to an exemplary embodiment.

Referring generally to FIGS. 44-46, face shield assembly 1010 including a face shield frame 1076 and a brim mount 1082 that form a hinge 1024, according to an exemplary embodiment. Face shield assembly 1010 is substantially similar to face shield assembly 910 except for the differences discussed herein. Face shield frame 1076 includes a pivot projection 1078 having a locking protrusion 1080. Locking protrusion 1080 includes a locking feature 1091. In a specific embodiment, locking protrusion 1080 is generally round but for locking feature 1091, which forms an angle along the perimeter of locking feature 1091 in a plane perpendicular to a pivot axis of hinge 1024. Locking feature 1091 has generally flat portions on either side of the angle.

Brim mount 1082 includes pivot receivers 1081 on opposing ends of brim mount 1082 such that the pivot axis passes through the center of pivot receivers 1081. Pivot receivers 1081 include a pivot slot 1084 formed by an outer retaining wall 1086 and an inner retaining wall 1087. Outer retaining wall 1086 and inner retaining wall 1087 are spaced apart from each other axial with respect to the pivot axis. Pivot receivers 1081 also include a radially interior wall 1089 that is spaced apart from inner retaining wall 1087 radially toward the pivot axis. Radially interior wall 1089 includes a retaining edge 1090 that extends substantially radially away from the pivot axis.

As shown in FIG. 44, when assembling face shield assembly 1010, pivot projection 1078 is aligned with pivot receiver 1081 along the pivot axis and locking protrusion 1080 is rotated about the pivot axis in a first direction into pivot slot 1084. To assemble face shield assembly 1010, face shield frame 1076 is then rotated about the pivot axis until locking protrusion 1080 passes retaining edge 1090, as shown in FIG. 45. Once locking protrusion 1080 passes retaining edge 1090, face shield frame 1076 is retained within one of a plurality of detents 1088 and can continue to rotate about the pivot axis away from retaining edge 1090 when sufficient force is applied. For example, face shield frame 1076 can continue to rotate beyond retaining edge 1090 into a lowered operating position in which locking protrusion 1080 is retained in another of detents 1088, as shown in FIG. 46.

When force is applied to face shield frame 1076 to rotate in a direction opposite the first direction past retaining edge 1090, retaining edge 1090 engages locking feature 1091 of locking protrusion 1080 and prevents face shield frame 1076 from rotating further. As such, once face shield assembly 1010 is assembled, retaining edge 1090 and locking feature 1091 prevent face shield assembly 1010 from being disassembled by rotating face shield frame 1076 in a direction opposite the first direction used to assemble face shield assembly 1010.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature. In addition, as used herein, the article "a" is intended to include one or more component or element and is not intended to be construed as meaning only one.

While the current application recites particular combinations of features in any claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A hard hat system comprising:

a hard hat comprising a brim and a shell formed from a rigid material, the hard hat being configured to receive a head of a wearer;

a face shield assembly comprising:

a lens having a lower portion extending in a first direction, an upper edge extending toward the shell in a second direction angled relative to the first direction, an interior surface, an exterior surface, and a plurality of lens apertures on the upper edge, the plurality of lens apertures facing the brim;

a hinge coupled to the hard hat and to the lens, the hinge being configured to actuate the lens between a lowered position and a raised position such that, when in the lowered position, the lens is at least partially below the brim and the interior surface of the lens faces toward the head of the wearer and the exterior surface of the lens faces away from the head of the wearer and, when in the raised position, the lens is at least partially above the brim;

a flexible gasket coupled to the upper edge of the lens and extending toward the shell of the hard hat;

wherein, when the lens is actuated between the lowered position and the raised position, the upper edge of the lens is spaced away from an outer surface of the shell of the hard hat defining a gap between the upper edge of the lens and the outer surface of the shell;

wherein, when the lens is actuated between the lowered position and the raised position, the flexible gasket extends across the gap between the upper edge of the lens and with the outer surface of the shell of the hard hat above the brim such that the flexible gasket limits particulate matter from passing between the upper edge of the lens and the shell of the hard hat and toward the interior surface of the lens.

2. The hard hat system of claim 1, the flexible gasket comprising:

a flexible gasket filler extending from the upper edge of the lens toward the shell of the hard hat; and a lip extending along the upper edge of the lens and coupling the flexible gasket filler to the lens.

3. The hard hat system of claim 2, the flexible gasket filler comprising a polymer material having a durometer that is less than a durometer of the lens.

4. The hard hat system of claim 2, the flexible gasket filler further comprising a plurality of gasket apertures; and the lip comprising a plurality of legs extending from a bottom surface of the lip toward an upward facing surface of the brim;

wherein each of the plurality of legs passes through one of the lens apertures of the plurality of lens apertures and also passes through one of the gasket apertures of the plurality of gasket apertures.

5. The hard hat system of claim 4, the plurality of legs each comprising a rib extending from a side of the leg;

wherein the rib of each of the plurality of legs engages the interior surface of the lens and restricts removal of the plurality of legs from the plurality of lens apertures.

6. The hard hat system of claim 5, wherein the plurality of legs are arranged in pairs of legs such that two legs pass through each of the plurality of lens apertures and through each of the gasket apertures, the ribs of the legs of each pair of legs extending in opposite directions with respect to each other.

7. The hard hat system of claim 1, wherein the flexible gasket extends from a first end of the hinge to a second opposing end of the hinge.

8. The hard hat system of claim 1, wherein the plurality of lens apertures are positioned along the upper edge of the lens and wherein each of the plurality of lens apertures faces an upward facing surface of the brim.

9. The hard hat system of claim 1, wherein, when the lens is in the lowered position, the upper edge of the lens is positioned between the brim and a gasket filler of the flexible gasket.

10. The hard hat system of claim 1, wherein the gasket seals the gap with respect to particulate matter and does not seal the gap with respect to gases.

11. A hard hat system comprising:

a hard hat comprising a brim and a shell formed from a rigid material, the brim extending outward from a front portion of the shell and the hard hat being configured to receive a head of a wearer;

a face shield assembly comprising:

a lens having a lower portion, an upper edge extending at an angle relative to the lower portion and toward the front portion of the shell, a plurality of lens apertures defined in the upper edge of the lens, an interior surface, and an exterior surface;

a hinge coupled to the hard hat and to the lens, the hinge being configured to actuate the lens between a lowered position and a raised position such that, when in the lowered position, the lens is at least partially below the brim and the interior surface of the lens faces toward the head of the wearer and the exterior surface of the lens faces away from the head of the wearer and, when in the raised position, the lens is at least partially above the brim;

a gasket comprising:

a flexible gasket filler extending from the upper edge of the lens toward the shell of the hard hat; and a lip extending along the upper edge of the lens and coupling the flexible gasket filler to the lens;

wherein, when the lens is actuated between the lowered position and the raised position, the upper edge of the lens is spaced away from the shell of the hard hat forming a gap between the upper edge of the lens and the shell of the hard hat;

wherein the upper edge of the lens is positioned between the flexible gasket filler and the brim; and wherein the gasket extends across the gap between the upper edge of the lens and the shell of the hard hat when the lens is actuated between the lowered position and the raised position such that the gasket seals the gap.

12. The hard hat system of claim 11, the flexible gasket filler comprising a polymer material having a durometer that is less than a durometer of the lens.

13. The hard hat system of claim 11, the flexible gasket filler comprising a plurality of gasket apertures, wherein the plurality of gasket apertures face the brim; and the lip comprising a plurality of legs extending from a bottom surface of the lip that faces downward toward the brim, the plurality of legs extending through one of the lens apertures of the plurality of lens apertures;

wherein each of the plurality of legs passes through one of the lens apertures of the plurality of lens apertures and also passes through one of the gasket apertures of the plurality of gasket apertures.

14. The hard hat system of claim 13, the plurality of legs each comprising a rib extending from a side of the leg;

wherein the rib of each of the plurality of legs engages the interior surface of the lens and restricts removal of the plurality of legs from the plurality of lens apertures.

15. The hard hat system of claim 14, wherein the plurality of legs are arranged in pairs of legs such that two legs pass through each of the plurality of lens apertures and through each of the gasket apertures, the ribs of the legs of each pair of legs extending in opposite directions with respect to each other.

16. The hard hat system of claim 11, wherein the flexible gasket filler extends continuously across the gap from a first end of the hinge to a second opposing end of the hinge.

17. The hard hat system of claim 11, wherein the gasket seals the gap with respect to particulate matter and does not seal the gap with respect to gases.

* * * * *